US011898792B2

(12) United States Patent
Choi

(10) Patent No.: US 11,898,792 B2
(45) **Date of Patent: *Feb. 13, 2024**

(54) REFRIGERATOR

(71) Applicant: LG ELECTRONICS INC., Seoul (KR)

(72) Inventor: Seonwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/880,665

(22) Filed: Aug. 4, 2022

(65) Prior Publication Data

US 2023/0134094 A1 May 4, 2023

Related U.S. Application Data

(62) Division of application No. 16/582,755, filed on Sep. 25, 2019.

(30) Foreign Application Priority Data

Jul. 12, 2019 (KR) ..... 10-2019-0084452

(51) Int. Cl.

| | |
|---|---|
| ***F25D 25/02*** | (2006.01) |
| ***F25D 23/02*** | (2006.01) |
| ***F25D 25/00*** | (2006.01) |
| ***A47B 88/457*** | (2017.01) |
| *A47B 88/90* | (2017.01) |

(52) U.S. Cl.

CPC ..... *F25D 25/005* (2013.01); *A47B 88/457* (2017.01); *F25D 25/025* (2013.01); *A47B 88/90* (2017.01); *A47B 2088/901* (2017.01); *A47B 2210/175* (2013.01); *F25D 2325/021* (2013.01)

(58) Field of Classification Search

CPC ..... F25D 25/005; F25D 25/025; F25D 2325/021; A47B 88/457; A47B 88/90; A47B 2088/901; A47B 2210/175

See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

United States Office Action dated Oct. 14, 2022 issued in co-pending related U.S. Appl. No. 16/585,816.

(Continued)

*Primary Examiner* — Kimberley S Wright

(74) *Attorney, Agent, or Firm* — KED & ASSOCIATES, LLP

(57) ABSTRACT

A refrigerator may include a rack gear assembly provided on a lower surface of a drawer. The rack gear assembly may have a first rack member and a second rack member that are pushed out by being moved forward sequentially so that a pushing-out distance of the drawer is maximized and the drawer is fully closed even when opposite sides thereof are pushed in a storage chamber without being in parallel.

17 Claims, 32 Drawing Sheets

(56) References Cited

U.S. PATENT DOCUMENTS

| | | | |
|---|---|---|---|
| 2,072,244 | A | 3/1937 | Coursen |
| 2,679,658 | A | 6/1954 | McCormick |
| 2,731,318 | A | 1/1956 | Hoff |
| 4,545,628 | A | 10/1985 | Richey |
| 5,253,488 | A | 10/1993 | Kim et al. |
| 6,044,606 | A | 4/2000 | Hamar |
| 6,109,774 | A | 8/2000 | Holmes et al. |
| 6,371,584 | B1 | 4/2002 | Alreck |
| 6,722,749 | B1 | 4/2004 | Pagac |
| 7,600,829 | B2 | 10/2009 | Oh et al. |
| 7,600,830 | B2 | 10/2009 | Oh et al. |
| 7,600,833 | B2 | 10/2009 | Oh et al. |
| 7,690,586 | B2 | 4/2010 | Kang |
| 8,282,177 | B1 | 10/2012 | Rotter |
| 8,360,539 | B2 | 1/2013 | Brown et al. |
| 8,376,481 | B2 | 2/2013 | Lee |
| 8,497,644 | B2 | 7/2013 | Eom et al. |
| 8,668,289 | B2 | 3/2014 | Lee et al. |
| 8,794,722 | B2 | 8/2014 | Nuss et al. |
| 8,844,110 | B2 | 9/2014 | Rotter |
| 8,864,249 | B2 | 10/2014 | Nam et al. |
| 9,107,494 | B2 | 8/2015 | Scheuring et al. |
| 9,377,238 | B2 | 6/2016 | Hall et al. |
| 9,523,533 | B2 | 12/2016 | Nam et al. |
| 9,982,937 | B2 | 5/2018 | Tierney et al. |
| 10,234,195 | B2 | 3/2019 | Yasaka et al. |
| 10,465,970 | B1 | 11/2019 | Kang et al. |
| 10,598,428 | B2 | 3/2020 | Kim |
| 10,690,401 | B2 | 6/2020 | Yang et al. |
| 10,712,083 | B1 | 7/2020 | Choi |
| 10,767,920 | B1 | 9/2020 | Choi |
| 10,786,080 | B1 | 9/2020 | Stravitz et al. |
| 10,876,788 | B2 | 12/2020 | Choi |
| 10,932,568 | B2 | 3/2021 | Subrahmanya et al. |
| 10,939,758 | B2 | 3/2021 | Kim |
| 11,033,104 | B2 | 6/2021 | Kim |
| 11,047,619 | B2 | 6/2021 | Choi |
| 11,131,500 | B2 | 9/2021 | Kim |
| 2003/0201700 | A1 | 10/2003 | Cho |
| 2004/0031705 | A1 | 2/2004 | Detemple, II et al. |
| 2004/0046488 | A1 | 3/2004 | Hogan |
| 2004/0056573 | A1 | 3/2004 | Chae |
| 2006/0042306 | A1 | 3/2006 | Choi et al. |
| 2006/0087207 | A1 | 4/2006 | Oh et al. |
| 2006/0087208 | A1 | 4/2006 | Oh et al. |
| 2006/0207283 | A1 | 9/2006 | Kim et al. |
| 2006/0248916 | A1 | 11/2006 | Kim et al. |
| 2006/0250062 | A1 | 11/2006 | Janda et al. |
| 2007/0262686 | A1 | 11/2007 | Ji |
| 2008/0018215 | A1 | 1/2008 | Carden et al. |
| 2009/0045713 | A1 | 2/2009 | Kunkle et al. |
| 2009/0160298 | A1 | 6/2009 | Chen et al. |
| 2009/0167131 | A1 | 7/2009 | Oh et al. |
| 2009/0277210 | A1 | 11/2009 | Eveland et al. |
| 2010/0192621 | A1 | 8/2010 | Kim |
| 2010/0236278 | A1 | 9/2010 | Eom et al. |
| 2010/0236279 | A1 | 9/2010 | Eom et al. |
| 2010/0239795 | A1 | 9/2010 | Gat |
| 2010/0283365 | A1 | 11/2010 | Chen |
| 2011/0005264 | A1 | 1/2011 | Lee et al. |
| 2011/0006656 | A1 | 1/2011 | Nam et al. |
| 2011/0050065 | A1 | 3/2011 | Lee et al. |
| 2011/0050066 | A1 | 3/2011 | Lee et al. |
| 2011/0146333 | A1 | 6/2011 | Koo et al. |
| 2011/0162402 | A1 | 7/2011 | Park |
| 2011/0181163 | A1 | 7/2011 | Han et al. |
| 2011/0210655 | A1 | 9/2011 | Brown et al. |
| 2012/0091872 | A1 | 4/2012 | Matthes et al. |
| 2012/0125035 | A1 | 5/2012 | Chellappan et al. |
| 2012/0306338 | A1 | 12/2012 | Nagahata et al. |
| 2013/0055543 | A1 | 3/2013 | Rotter |
| 2013/0129267 | A1 | 5/2013 | Chen |
| 2013/0145972 | A1 | 6/2013 | Knox et al. |
| 2013/0264928 | A1 | 10/2013 | Hong et al. |
| 2013/0270986 | A1 | 10/2013 | Min et al. |
| 2013/0270987 | A1 | 10/2013 | Kelly |
| 2013/0270989 | A1 | 10/2013 | Park et al. |
| 2014/0191646 | A1 | 7/2014 | Nuss et al. |
| 2014/0265783 | A1 | 9/2014 | Hauer et al. |
| 2014/0265797 | A1 | 9/2014 | Scheuring et al. |
| 2014/0265806 | A1 | 9/2014 | Hall et al. |
| 2014/0319990 | A1 | 10/2014 | Gephart et al. |
| 2015/0059398 | A1 | 3/2015 | Yoo et al. |
| 2015/0059399 | A1 | 3/2015 | Hwang et al. |
| 2015/0069899 | A1 | 3/2015 | Han et al. |
| 2015/0184918 | A1 | 7/2015 | Klingshirn et al. |
| 2016/0146533 | A1 | 5/2016 | Jung |
| 2016/0153704 | A1 | 6/2016 | Burke et al. |
| 2016/0178274 | A1 | 6/2016 | Shin |
| 2016/0265816 | A1 | 9/2016 | Gillette et al. |
| 2016/0305705 | A1 | 10/2016 | Dubina et al. |
| 2016/0320118 | A1 | 11/2016 | Millett |
| 2016/0370063 | A1 | 12/2016 | Yang |
| 2017/0024946 | A1 | 1/2017 | Hashemi et al. |
| 2017/0051967 | A1 | 2/2017 | Tierney et al. |
| 2017/0122651 | A1 | 5/2017 | Cizik et al. |
| 2017/0227279 | A1 | 8/2017 | Yang et al. |
| 2017/0336129 | A1 | 11/2017 | Cunningham |
| 2017/0362864 | A1 | 12/2017 | Fazi et al. |
| 2018/0128540 | A1 | 5/2018 | Yasaka et al. |
| 2018/0283771 | A1 | 10/2018 | Shin et al. |
| 2018/0291669 | A1 | 10/2018 | Kim et al. |
| 2018/0356148 | A1 | 12/2018 | Fei et al. |
| 2019/0219324 | A1 | 7/2019 | Kang |
| 2019/0242640 | A1 | 8/2019 | Minoru et al. |
| 2019/0292831 | A1 | 9/2019 | Choi |
| 2019/0293341 | A1 | 9/2019 | Yeom |
| 2019/0323763 | A1 | 10/2019 | Kang |
| 2019/0346199 | A1 | 11/2019 | Choi |
| 2019/0390895 | A1 | 12/2019 | Choi |
| 2020/0011593 | A1 | 1/2020 | Ji |
| 2020/0069056 | A1 | 3/2020 | Kim |
| 2020/0072533 | A1 | 3/2020 | Cho |
| 2020/0072540 | A1 | 3/2020 | Kim |
| 2020/0072542 | A1 | 3/2020 | Kim |
| 2021/0003337 | A1 | 1/2021 | Voltarelli et al. |
| 2021/0259416 | A1 | 8/2021 | Kim |

FOREIGN PATENT DOCUMENTS

| | | |
|---|---|---|
| CN | 102226626 | 10/2011 |
| CN | 202254607 | 5/2012 |
| CN | 202970226 | 6/2013 |
| CN | 204902419 | 12/2015 |
| CN | 107388718 | 11/2017 |
| CN | 108645104 | 10/2018 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10-2005-016418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H04-138337 | 12/1992 |
| JP | H07-275049 | 10/1995 |
| JP | H08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |

(56) References Cited

FOREIGN PATENT DOCUMENTS

| | | |
|---|---|---|
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |
| KR | 10-2010-0078916 | 7/2010 |
| KR | 10-2011-0014331 | 2/2011 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | WO 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

GE (Refrigerator Freezer Door Pops Open, http:/ / products. geapplicances.com/ appliance/ gea-support-search-content?contentId= 16979) (Year: 2015).
United States Office Action dated Mar. 4, 2020 issued in U.S. Appl. No. 16/582,712.
United States Office Action dated Mar. 9, 2020 issued in U.S. Appl. No. 16/582,810.
European Search Report dated Mar. 12, 2020 issued in Application No. 19199586.9.
European Search Report dated Mar. 17, 2020 issued in Application No. 19199553.9.
European Search Report dated Mar. 20, 2020 issued in Application No. 19199569.5.
European Search Report dated Mar. 23, 2020 issued in EP Application No. 19199602.4.
European Search Report dated Mar. 30, 2020 issued in Application No. 19199556.2.
European Search Report dated Apr. 1, 2020 issued in EP Application No. 19199637.0.
European Search Report dated Apr. 3, 2020 issued in Application No. 19199625.5.
European Search Report dated Apr. 6, 2020 issued in Application No. 19199587.7.
European Search Report dated Apr. 6, 2020 issued in Application No. 19199629.7.
European Search Report dated Apr. 7, 2020 issued in Application No. 19199607.3.
European Search Report dated Aug. 14, 2020 issued in EP Application No. 19199647.9.
European Office Action dated Sep. 30, 2020 issued in EP Application No. 19199556.2.
United States Office Action dated Nov. 19, 2020 issued in co-pending related U.S. Appl. No. 16/582,831.
European Communication dated Feb. 8, 2021 issued in EP Application No. 19199627.1.
Chinese Office Action dated Aug. 20, 2021 issued in CN Application No. 201910857469.X.
Chinese Office Action dated Aug. 24, 2021 issued in CN Application No. 201910911796.9.
Chinese Office Action dated Aug. 25, 2021 issued in CN Application No. 201910911807.3.
European Office Action dated Sep. 1, 2021 issued in EP Application No. 19199607.3.
Chinese Office Action dated Sep. 2, 2021 issued in CN Application No. 201910871084.9.
Chinese Office Action dated Sep. 3, 2021 issued in CN Application No. 201910905106.9.
Chinese Office Action dated Sep. 8, 2021 issued in CN Application No. 201910857458.1.
Chinese Office Action dated Sep. 14, 2021 issued in CN Application No. 201910905166.0.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
United States Office Action dated Oct. 15, 2021 issued in co-pending related U.S. Appl. No. 16/582,755.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
United States Office Action dated Apr. 11, 2022 issued in co-pending related U.S. Appl. No. 16/585,301.
Chinese Office Action dated May 16, 2022 issued in CN Application No. 201910905106.9.
United States Office Action dated Jan. 5, 2023 issued in co-pending related U.S. Appl. No. 16/585,301.

REFRIGERATOR

CROSS-REFERENCE TO RELATED APPLICATIONS

This application is a Divisional Application of U.S. patent application Ser. No. 16/582,755 filed Sep. 25, 2019, which claims priority under 35 U.S.C. § 119 to Korean Application No. 10-2019-0084452, filed Jul. 12, 2019, whose entire disclosures are hereby incorporated by reference.

BACKGROUND

1. Field

The present disclosure relates to a refrigerator having a drawer.

2. Background

A refrigerator is a home appliance that is provided to store various foods or beverages for a long time by cold air generated by circulation of a refrigerant according to a refrigeration cycle.

The refrigerator may be divided into two types of refrigerators: a common refrigerator that can store storage items a user wants to store regardless of a type of food or drink; and an exclusive-use refrigerator that varies in size or function based on a type of storage item to be stored.

The exclusive use refrigerator may include a kimchi refrigerator, a wine refrigerator, and so on.

The refrigerator may be classified into various types depending on a door opening and closing method of a storage chamber in a cabinet, such as a swinging door-type refrigerator, a drawer-type refrigerator, and a hybrid-type refrigerator having both doors and drawers. The hybrid-type refrigerator has a structure in which a swinging door is provided in an upper portion of the cabinet and a drawer is provided in a lower portion thereof.

The drawer provided in the drawer refrigerator or the hybrid-type refrigerator may open, by a user's operation, from an inside space of the cabinet in a sliding manner. The drawer may close by being pushed into the inside space of the cabinet by user's pushing operation, thereby allowing an open front portion of the cabinet to be closed.

The drawer may include a front panel and a storage bin (or storage room), the front panel forming a front surface of the refrigerator and being moved forward and rearward, thereby allowing the inside space of the cabinet to be opened/closed and the storage bin being provided in rear of the front panel and received in the inside space of the cabinet. By pulling the front panel, the storage bin may be pushed out from the inside space of the cabinet, thus various foods can be stored in and taken out from the storage bin.

The drawer provided in the drawer refrigerator or the hybrid-type refrigerator is mainly provided in the lower portion of the cabinet. This is because, due to weight of storage items stored in the storage bin of the drawer, the drawer may be removed from the cabinet and fall down when the drawer is opened.

However, when the drawer is provided in the lower portion of the cabinet, the user may bend over at the waist while keeping away from the front panel by an appropriate distance for opening of the drawer.

Korean Patent Application Publication No. 10-2009-0102577, Korean Patent Application Publication No. 10-2009-0102576, Korean Patent Application Publication No. 10-2013-0071919, and Korean Patent Application Publication No. 10-2018-0138083, the subject matters of which are incorporated herein by reference, may disclose features of a refrigerator in which a drawer may be automatically opened.

A rack and a pinion may be used for automatic opening of the drawer.

That is, as the rack and the pinion may be respectively installed in the drawer and the storage chamber opposed thereto in the cabinet, and the drawer can be moved forward automatically.

However, the drawer may be configured of a structure in which guide racks are respectively provided at opposite walls in the cabinet and pinions are respectively provided at opposite walls (e.g., opposite sides of rear surface) of the storage bin (constituting the drawer) to move the drawer forward and rearward. Therefore, there may be a limit to a pushing-distance of the drawer.

That is, considering that the pushing-out distance of the drawer is proportional to a length of a guide rack, when the guide rack is not provided outwards from inside of the cabinet, the storage bin of the drawer can not be fully exposed from the inside of the cabinet, and it may be inconvenient to take storage items out of the storage bin.

In an example of the drawer of the refrigerator, when a rack gear of any one side guide rack is engaged with any one pinion before a rack gear of the other side instead of rack gears of the opposite guide racks being engaged with the opposite pinions in a process of closing the drawer, the drawer may not precisely close into the storage chamber.

In the above example, the pinion and the rack gear of the guide rack may not be precisely engaged, thereby causing malfunction, and the front panel and the cabinet may not be in close contact with each other and a gap may occur therebetween. Accordingly, an opening operation may not be easily performed when the drawer is later re-opened.

If engagement between the rack gear (of each rack gear) and the pinion is not performed horizontally but rather is performed obliquely, the pinion and the rack gear may be damaged.

BRIEF DESCRIPTION OF THE DRAWINGS

Arrangements and embodiments may be described in detail with reference to the following drawings in which like reference numerals refer to like elements, and wherein.

DETAILED DESCRIPTION

An exemplary embodiment with respect to a refrigerator of the present disclosure may be described in detail with reference to accompanying FIGS. 1 to 34.

Figure 1:
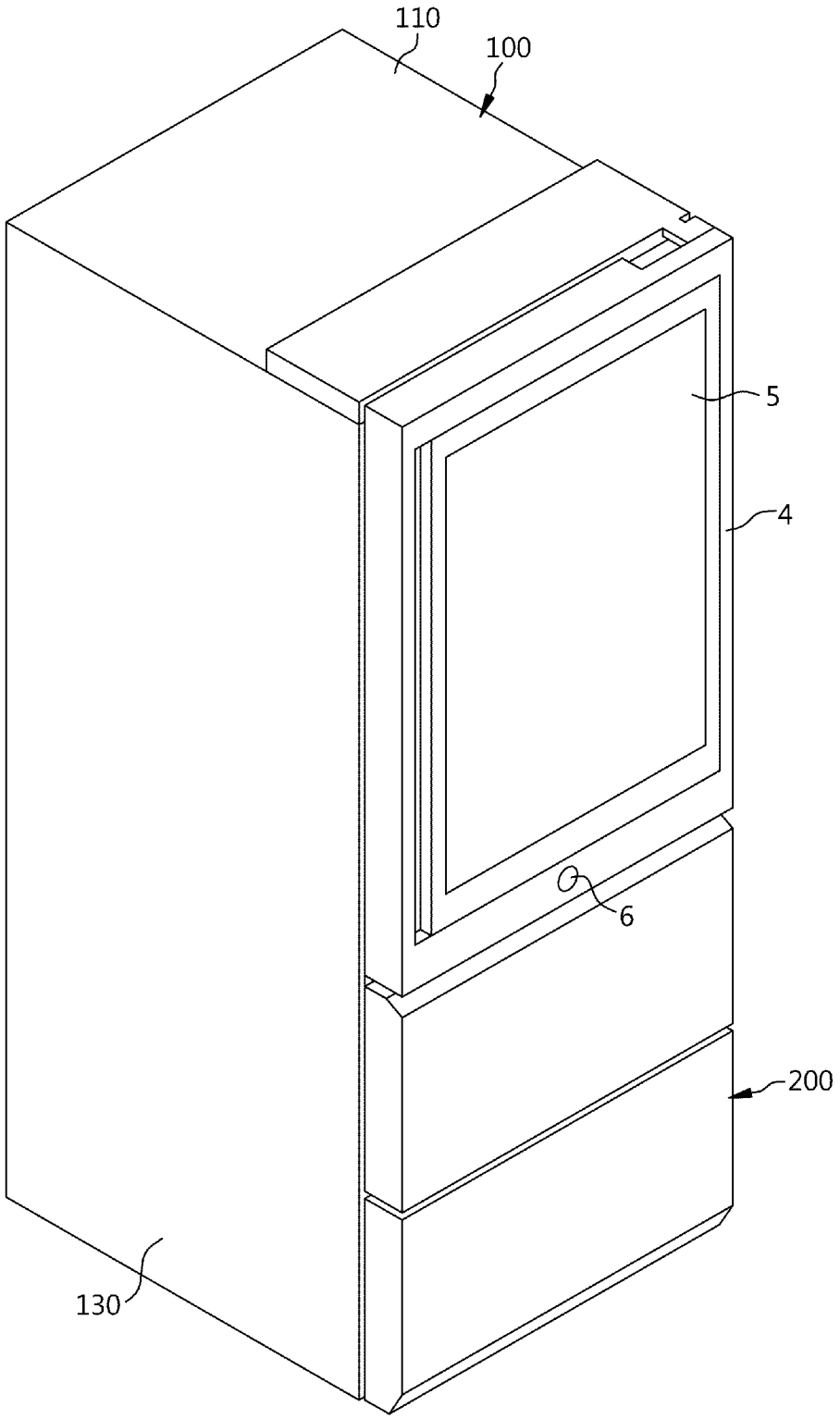
FIG. 1 is a perspective view showing a refrigerator according to an embodiment of the present disclosure.
Figure 2:
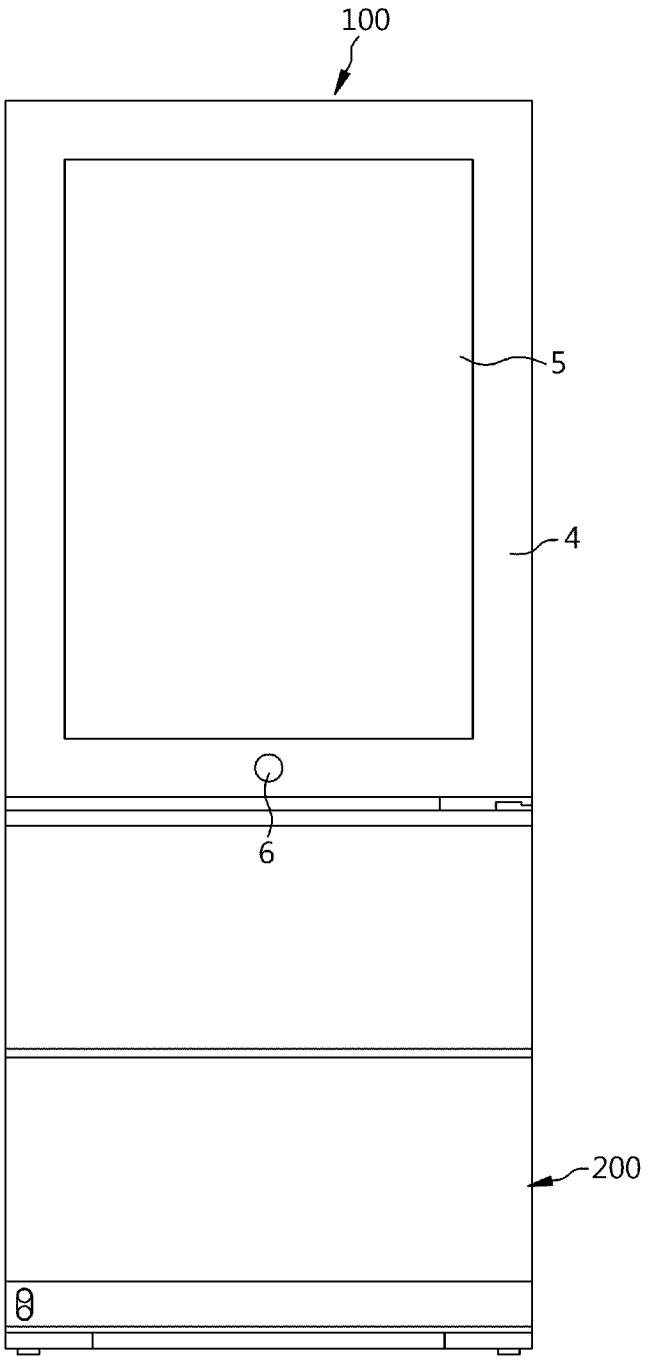
FIG. 2 is a front view showing the refrigerator according to an embodiment of the present disclosure.
Figure 3:
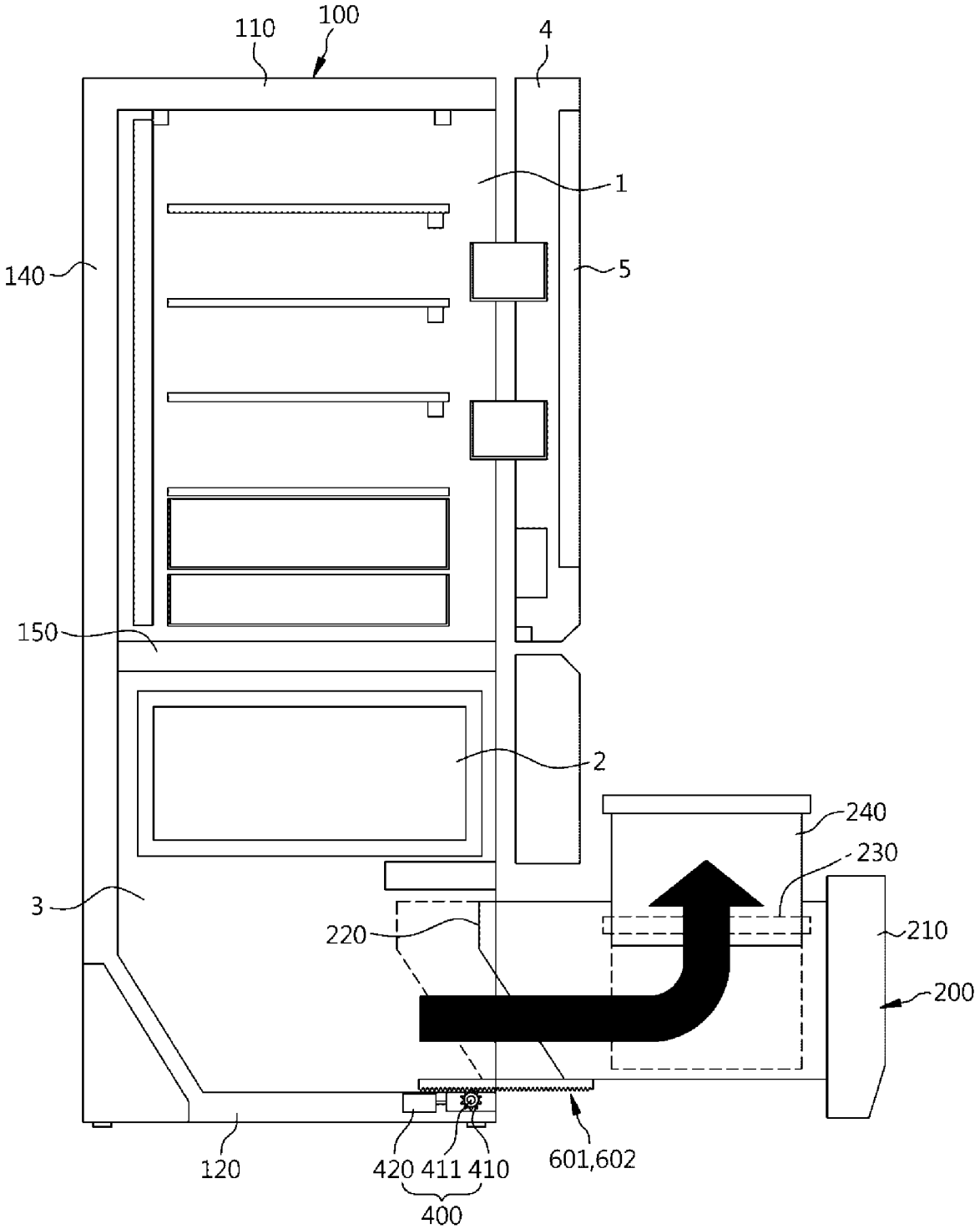
FIG. 3 is a side view showing the refrigerator according to an embodiment of the present disclosure.

FIG. 1 is a perspective view showing a refrigerator according to an embodiment of the present disclosure. FIG. 2 is a front view showing the refrigerator according to an embodiment of the present disclosure. FIG. 3 is a side view showing the refrigerator according to an embodiment of the present disclosure.

As shown in the drawings, a refrigerator according to an example embodiment of the present disclosure may include a cabinet 100, a drawer 200, a driving part 400 (or driving device), and rack gear assemblies 601 and 602. At least any one rack gear assembly of the rack gear assemblies 601 and 602 is provided with an idle gear 630 (referring to FIG. 11). The idle gear may engage with gear teeth of a pinion 410 of the driving part, and may allow the pinion 410 to be idle.

The cabinet 100 may constitute an outer appearance of the refrigerator.

The cabinet 100 may include an upper wall or a roof 110 forming an upper side wall, a bottom 120 forming a lower side wall, two side walls 130 forming opposite side walls, and a rear wall 140 forming a rear side wall, and the cabinet may be configured as a box-shaped body which is opened forward. An inside space of the cabinet 100 may be used as a storage space.

A plurality of partition walls 150 may be provided inside the cabinet 100. The partition walls 150 may divide the storage space in the cabinet 100 into a plurality of spaces, so that the storage space is provided as a plurality of vertically separated storage chambers (1, 2, and 3).

In other implementations, the partition walls 150 may be provided to partition the storage space in the cabinet 100 into storage chambers that are horizontally positioned.

The refrigerator according to an embodiment of the present disclosure is provided with three storage chambers partitioned up and down. An upper storage chamber 1 may be a refrigerator chamber, and a center storage chamber 2 and a lower storage chamber 3 may be a refrigerator chamber or a freezer chamber, or a separate space.

Each of storage chambers (1, 2, and 3) of the cabinet 100 is configured to be separately opened and closed by a door thereof. The upper storage chamber 1 may be opened and closed by a swinging door 4, and the center storage chamber 2 and the lower storage chamber 3 may be opened and closed by the drawer 200. The center storage chamber 2 may be configured to be opened and closed by the swinging door 4.

The swinging door 4 may be hingedly coupled to the cabinet 100 in a swinging manner, and the swinging door 4 may rotate to open or close an opening of the upper storage chamber 1.

A display part 5 (or display) may be provided on a front surface of the swinging door 4 for outputting information. A variety of different information such as an operational state of the refrigerator or temperatures of each storage chamber (1, 2, and 3) may be displayed on the display part 5.

The display part 5 may include at least one of LCD, LED, and so on.

The drawer 200 may open and close in a sliding manner. In an embodiment described below, the drawer 200 may be provided at the lower storage chamber 3 and may open in a drawer manner.

The drawer 200 may include the front panel 210 and a storage bin 220 (or storage room).

The front panel 210 may be pushed into the storage chamber so that the open front of the lower storage chamber 3 is closed and shielded, and the front panel 210 may be an installation space therein.

The front panel 210 may be formed such that a metal thin plate is folded into multiple stages so as to have each wall surface (upper surface, opposite side surfaces, front surface, and lower surface). The front panel 210 may be provided with an inner frame therein. The inner frame 211 may be formed of resin for reducing a weight of the front panel and improving productivity thereof. The front panel 210 may be formed of a material having metal texture.

The storage bin 220 may be provided at a rear of the front panel 210 and is received in the lower storage chamber 3.

The storage bin 220 may be formed in a box-shaped body that is open upward, and a front surface of the storage bin 220 may be fixed to a rear surface of the front panel 210 in a close contact state therewith. The storage bin 220 and the front panel 210 may be coupled to each other by hook or bolt fastening, screw fastening, gearing, fitting, and so on.

Guide rails 230 may be respectively provided on opposite outside walls of the storage bin 220 and on opposite inner side walls of the lower storage chamber 3 (referring to FIG. 3). The inner side walls of the lower storage chamber 3 may face the outer side walls of the storage bin 220. The guide rails of the storage bin 220 and the guide rails of the lower storage chamber 3 are engaged with each other and support forward and rearward movement of the storage bin 220.

Although not shown, the guide rails 230 may be respectively provided on a lower surface of the storage bin 220 and a bottom surface in the lower storage chamber 3, and the guide rails may be engaged with each other, where the bottom surface in the lower storage chamber 3 face the lower surface of the storage bin 220. The guide rails 230 may also be configured to extend into multiple stages.

A separate container 240 may be provided in the storage bin 220. That is, a variety of food may be stored in the storage bin 220, but the container 240 is in the storage bin 220 so that the food may be stored in the container 240. The container 240 may be a kimchi container or a basket to be opened upwardly.

When the storage bin 220 is pushed out from the lower storage chamber 3, the container 240 may move upward in the storage bin 220.

In order for a user to raise the container 240 in the storage bin 220, it is necessary to form a gap in which fingers of the user are inserted between the storage bin 220 and the container 240, so a size of the container 240 should be reduced by a size of the gap. Accordingly, the container 240 may be automatically separated from the storage bin 220 in order that the size of the container 240 is maximized. When the container 240 is automatically separated from the storage bin 220, the user can easily take out the container 240.

Figure 4:
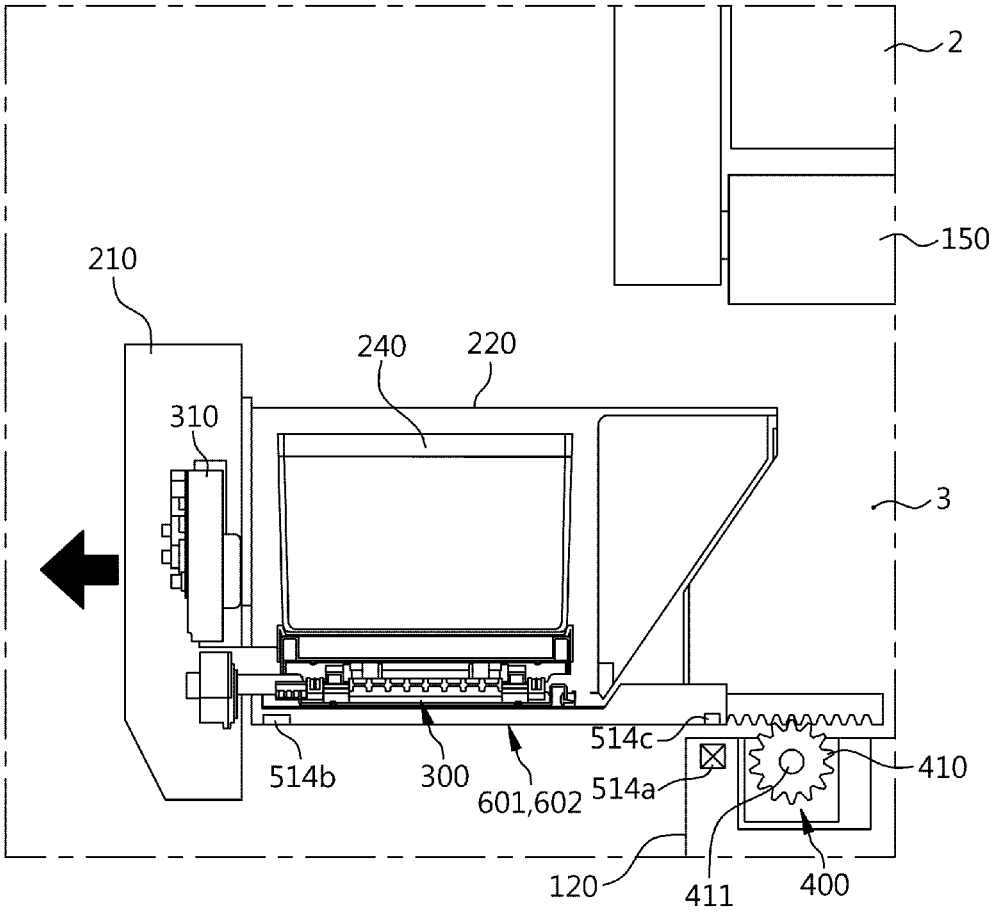
FIG. 4 is a main part view showing schematically the refrigerator according to the embodiment of the present disclosure, wherein a drawer of the refrigerator is opened.
Figure 5:
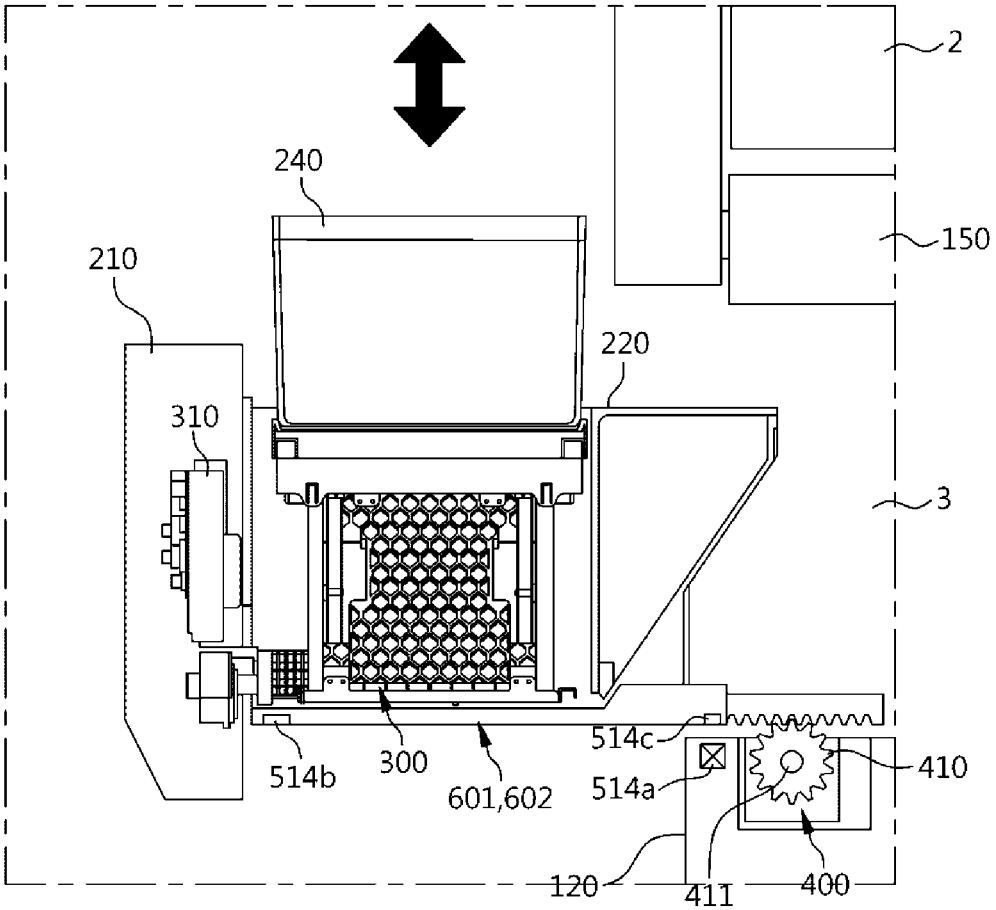
FIG. 5 is a main part view showing schematically the refrigerator according to the embodiment of the present disclosure, wherein a container is raised upward when the drawer of the refrigerator is opened.

A raising/lowering module 300 (or lift module) may be provided in the storage bin 220 to automatically raise the container 240 (referring to FIGS. 4 and 5).

The raising/lowering module 300 may be embodied in various forms. For example, the raising/lowering module 300 may be formed in a scissors linkage structure, such that when the raising/lowering module is folded, a height is minimized, and when the raising/lowering module is unfolded, the height thereof is maximized.

Electrical parts 310 (for example, drive motor, etc.) supplying a driving force for raising movement of the raising/lowering module 300 may be provided in the installation space in the front panel 210.

When the raising/lowering module 300 is operated before the storage bin 220 of the drawer 200 is fully pushed out, the container 240 or the cabinet 100 may be broke. Therefore, a control program may be programmed to operate the raising/lowering module only when the storage bin 220 is fully pushed out, and the control program being programmed to control movement of the raising/lowering module 300.

The driving part 400 may provide a driving force for forward and rearward movement of the drawer 200.

The driving part 400 may be provided on the bottom 120 of the cabinet 100, and may include a pinion 410 and a driving motor 420.

Figure 9:
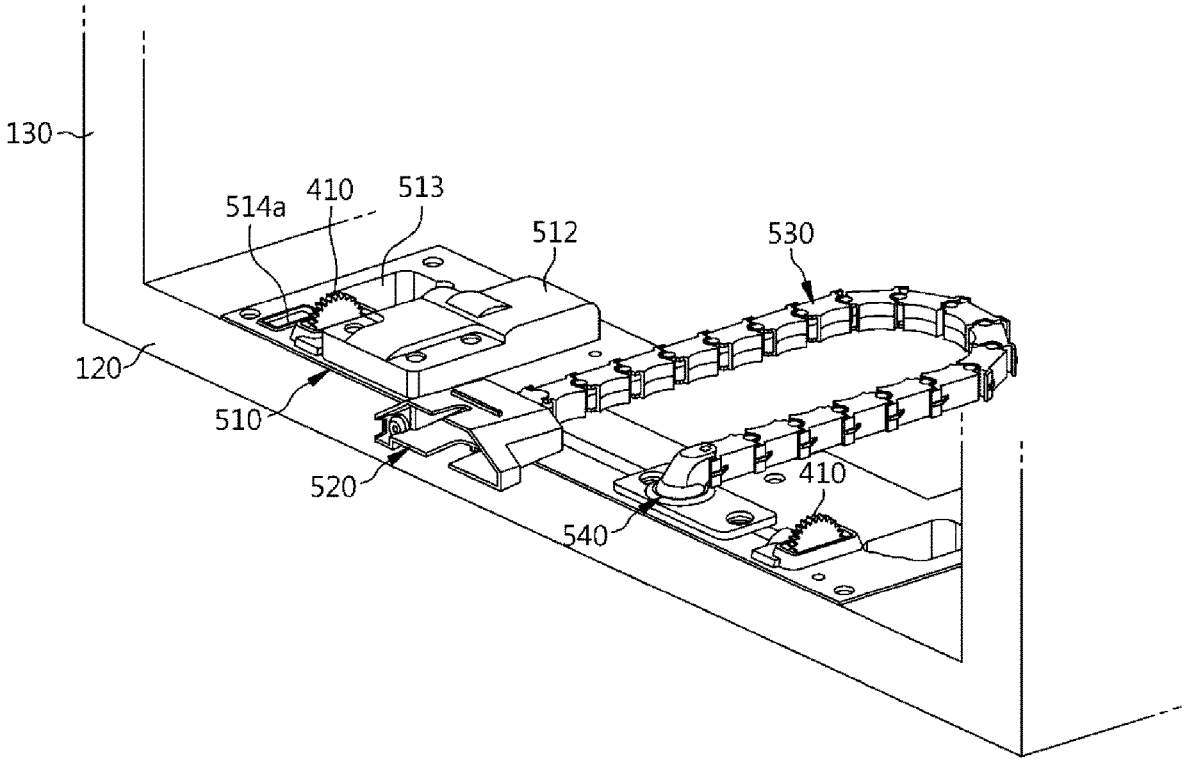
FIG. 9 is a perspective view showing an installation state of the cable guide module installed in a storage chamber.
Figure 10:
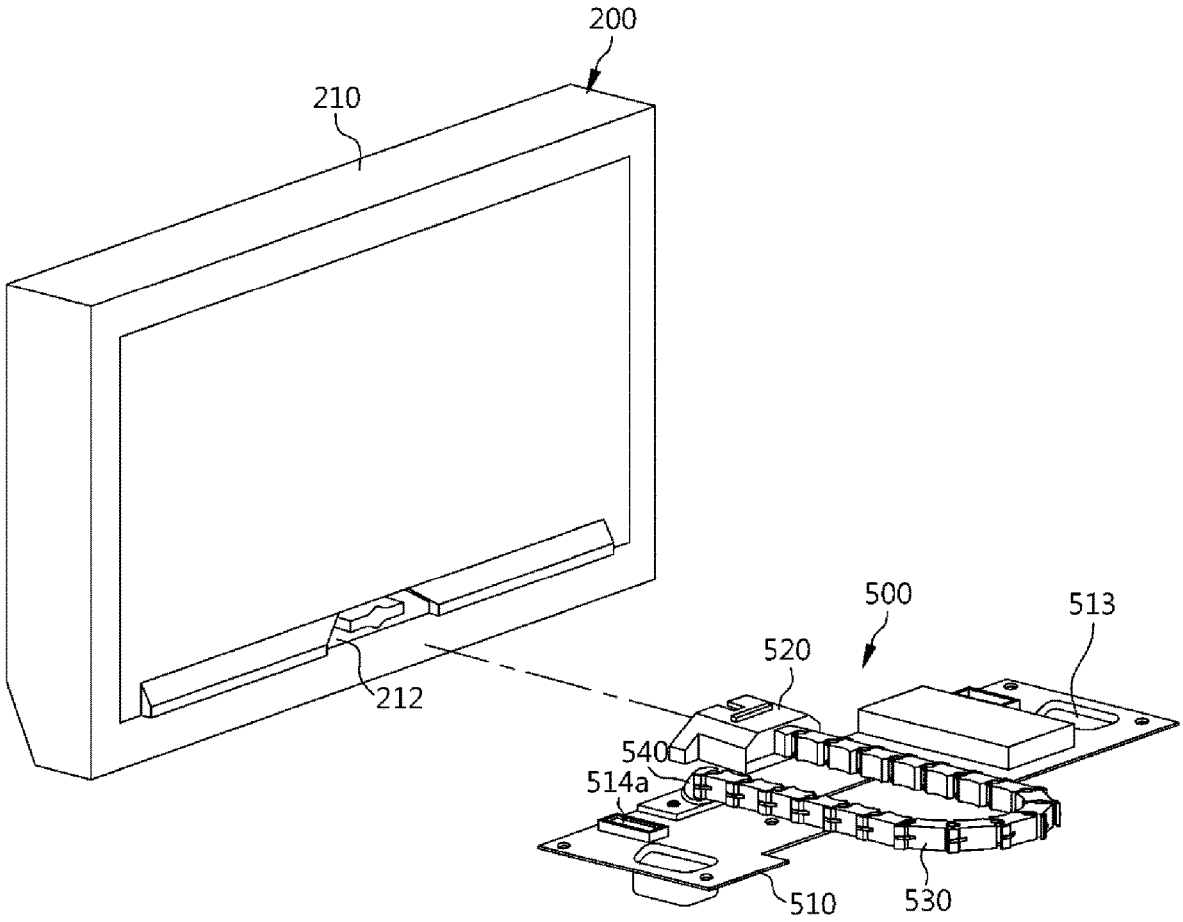
FIG. 10 is a perspective view showing the drawer taken at the rear side, wherein the cable guide module of the refrigerator according to the embodiment of the present disclosure is connected to the drawer.

The pinion 410 may penetrate partially through the bottom surface (upper surface of the bottom) in the lower storage chamber 3 and may be exposed to the inside of the lower storage chamber 3 (referring to FIG. 9). The driving motor 420 may supply power to the pinion 410 while being fixed at the bottom 120 of the cabinet 100.

In an embodiment of the present disclosure, two pinions 410 may be respectively provided one by one on opposite sides of the bottom surface of the lower storage chamber 3. The two pinions 410 may be connected to each other by a power transmission shaft 411. The driving motor 420 may be connected to the power transmission shaft 411 by a belt, a chain, or a gear for supplying power thereto. The two pinions may be called a first pinion and a second pinion.

By the driving of the driving motor 420, the two pinions 410 may rotate at the same time with the same speed and direction.

A reduction gear (or reducer) may be provided in a connecting portion between the power transmission shaft 411 and the driving motor 420.

The two pinions 410 may be positioned at foremost sides of the bottom surface in the lower storage chamber 3. Thus, the drawer may open to the maximum.

The driving motor 420 may operate when proximity of the user is sensed, or may operate when a button 6 is manipulated by the user.

The button 6 may be a touch-type button provided on the display part 5 of the swinging door 4. The button 6 may also be a pressure-type button provided on a separate position from the display part 5.

Figure 6:
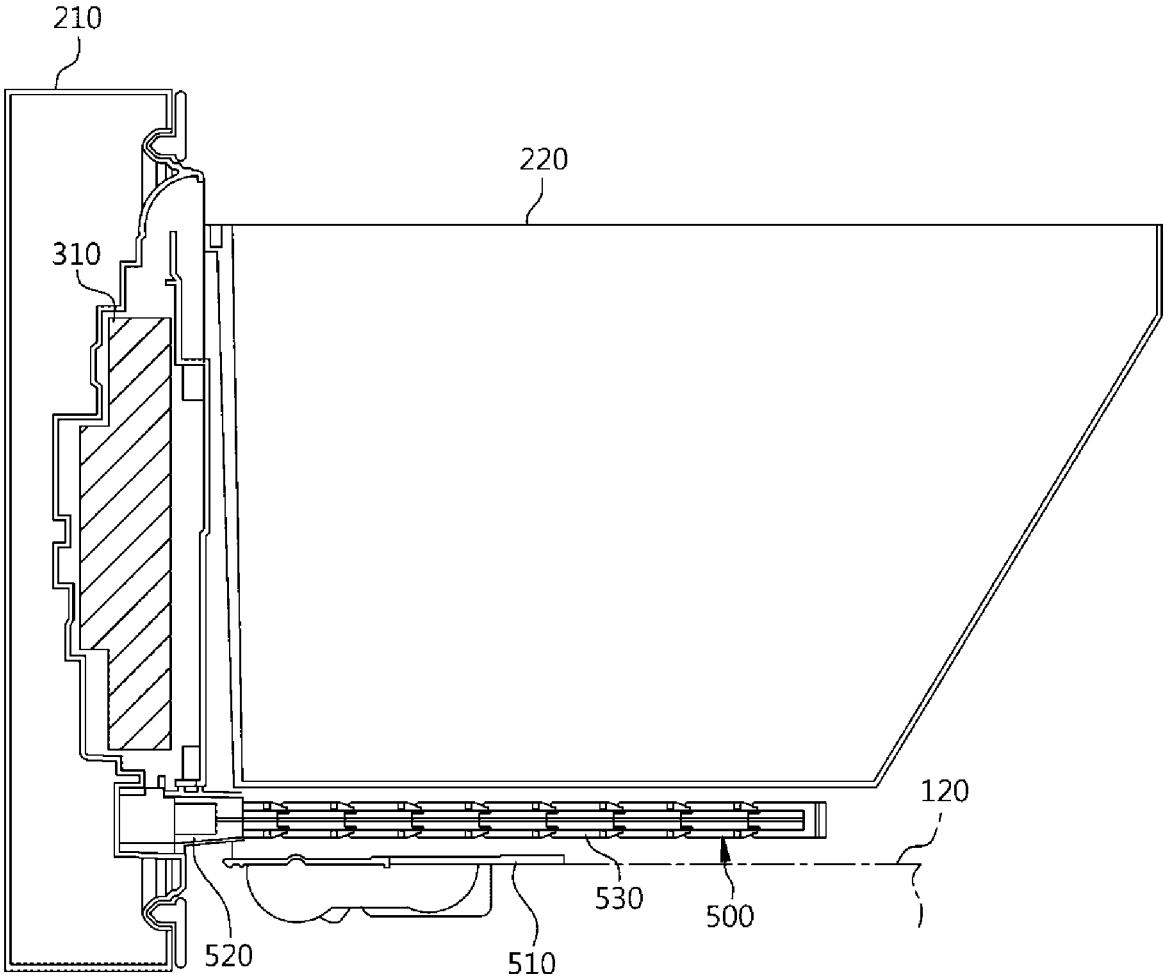
FIG. 6 is a side view showing the drawer of the refrigerator according to the embodiment of the present disclosure, the drawer being equipped with a cable guide module.

A cable guide module 500 may be connected to the bottom surface (upper surface of the bottom) in the lower storage chamber 3 and to the front panel 210 (referring to FIG. 6).

The cable guide module 500 may protect a power line and cables (hereinafter referred to as cables), which are connected to the electrical parts in the front panel 210 among various power lines and cables connected along the inside of the bottom 120.

The cable guide module 500 may be configured to guide the cables to be moved with forward and rearward movements of the drawer 200, and to prevent the cables from being damaged due to twisting and scraping.

The cable guide module 500 may include a cover plate 510, a guiding head 520, a plurality of connecting members 530, a swinging connection member 540 (or swinging connection base), and a mounting plate 550, as shown in FIGS. 7 to 10.

The cable guide module 500 may be described in detail on a per component basis.

The cover plate 510 of the cable guide module 500 may be a part coupled to the upper surface of the bottom 120.

A part of a front upper surface of the bottom 120 may be formed to be open, and the cover plate 510 may be coupled to the bottom 120 and cover the open part thereof.

Figure 7:
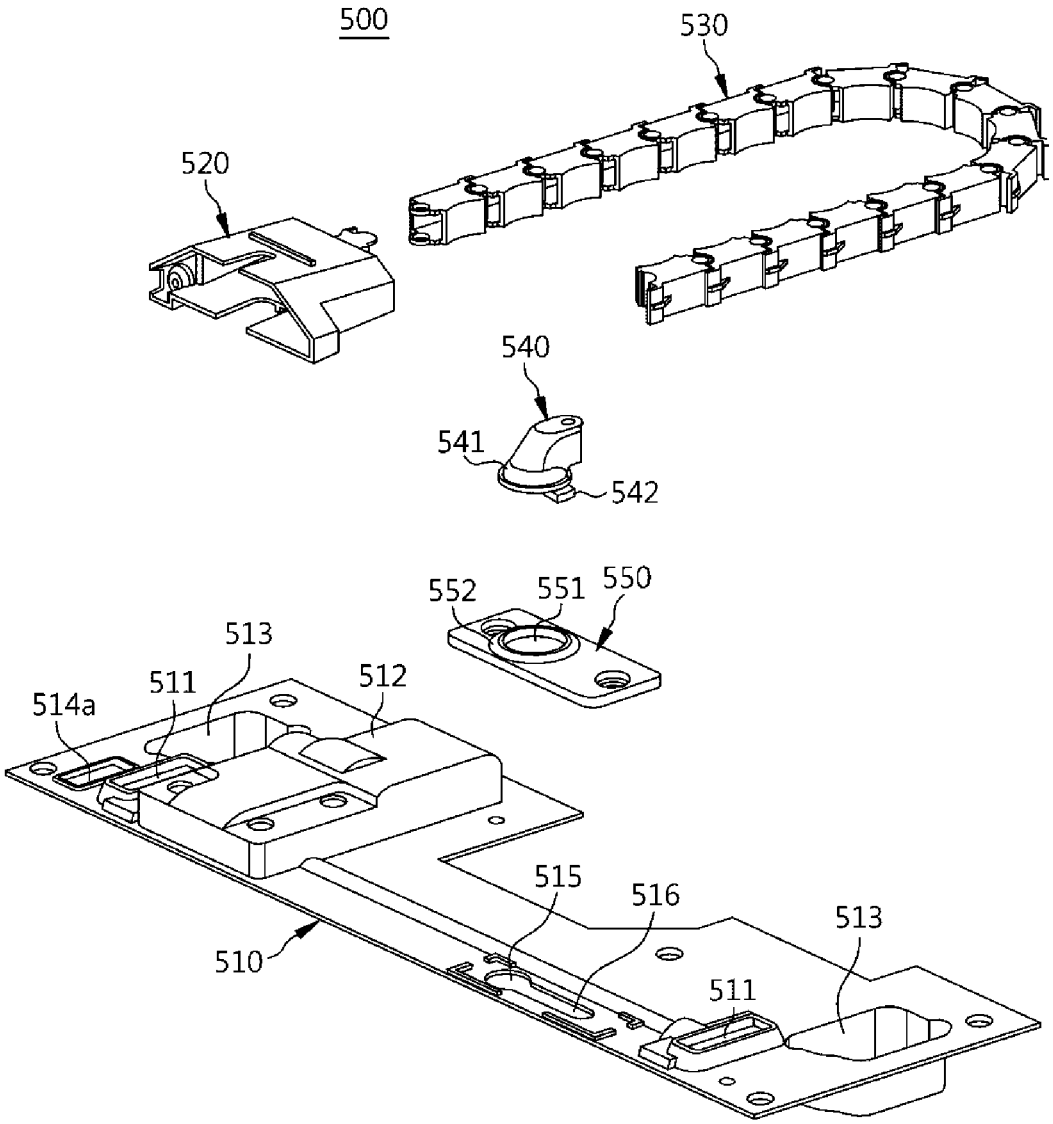
FIG. 7 is an exploded-perspective view showing the cable guide module of the refrigerator according to the embodiment of the present disclosure.
Figure 8:
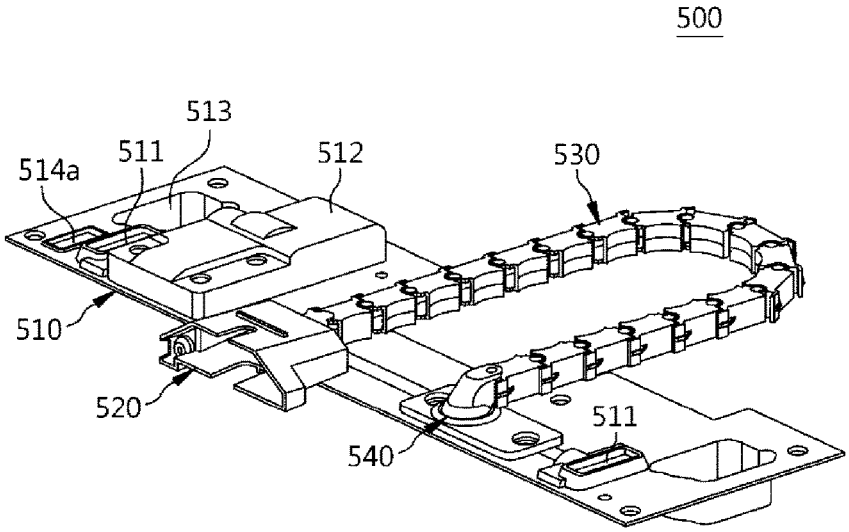
FIG. 8 is a perspective view showing a coupled state of the cable guide module of the refrigerator according to the embodiment of the present disclosure.

Two pinion exposure holes 511 may be respectively provided on opposite sides of the cover plate 510 in a penetrating manner so that the pinions 410 of the driving part 400 are exposed (referring to FIGS. 7 and 8).

The cover plate 510 may be provided with a motor receiving part 512 that receives the driving motor 420 (included in the driving part 400) (referring to FIG. 7). The motor receiving part 512 may protrude from a part of the cover plate 510 that protrudes upward, or may be formed separately from the cover plate 510 and then coupled to the cover plate 510. Although not shown, the motor receiving part 512 may be formed in different forms or manners.

Two protrusion passing holes 513 may be respectively formed through opposite sides in the rear of the cover plate 510, and each protrusion passing holes 513 may be for installation of a confining protrusion part 650, which may be described below. An upper end of the confining protrusion part 650 may be exposed toward the inside of the lower storage chamber 3 while the confining protrusion part 650 is accommodated in the protrusion passing hole 513. The confining protrusion part 650 may be described again in a description about rack gear assemblies 601 and 602 to be described below.

An open/close sensing part 514 (or sensing device) may include components provided at a bottom in the storage chamber and the drawer that is opposed thereto to sense opening and closing of the drawer 200 (referring to FIGS. 4 and 5). That is, as the open/close sensing part 514 is provided, it may check accurately whether the drawer 200 is fully closed or partially opened.

The open/close sensing part 514 may include a sensor 514*a* and a sensing member 514*b*. The sensor 514*a* may be a hall sensor, and the sensing member 514*b* may be a magnet that is sensed by the hall sensor. The open/close sensing part 514 may be provided as various structures such as an optical sensor, a switch, and so on.

The sensor 514*a* (of the open/close sensing part 514) may be provided at the bottom in the lower storage chamber 3. The sensing member 514*b* may be provided at the lower surface of the storage bin 220 (constituting the drawer 200). Although not shown, the sensing member 514*b* may be provided at the bottom in the lower storage chamber 3 and the sensor 514*a* may be provided at the lower surface of the storage bin 220, or the sensor 514*a* may be provided at any one side wall surface in the lower storage chamber 3 and the sensing member 514*b* may be provided at a wall surface of the storage bin 220, the wall surface of the storage bin faces the sensor.

The sensor 514*a* may be provided at the cover plate 510 positioned at the bottom in the lower storage chamber 3, so that maintenance of the cover plate 510 can be performed through removal thereof.

In an end of a lower surface of the rack gear assembly 600, a separate sensing member 514*c* may be provided so that the sensor 514*a* senses the full opening of the drawer 200 when the rack gear assembly 600 is fully pushed out.

The open/close sensing part 514 may be configured to influence operation control of the driving part 400.

When the open/close sensing part 514 (or sensing device) senses the closing of the drawer 200, the open/close sensing part 514 is configured so that the driving motor 420 constituting the driving part 400 may perform additional operation from the sensing time by a predetermined time or a predetermined number of rotations and then deactivates the operation.

When the open/close sensing part 514 (or sensing device) senses the closing of the drawer 200, the driving motor 420 is programmed to perform additional drive by at least one pitch of a rack gear 611 of a first rack member 610 and then to deactivate the driving.

When left and right sides of the drawer 200 are moved obliquely instead of parallel so that any one side of the drawer 200 reaches a closing position thereof earlier than the other side, although the other side is not closed, the sensor 514*a* (of the open/close sensing part 514) may determine that the drawer 200 is closed.

Even when one side of the drawer 200 is closed earlier than the other side, the other side is moved further by a distance of at least one pitch of the rack gear 611 from this time, so that opposite sides of the drawer 200 may be closed.

The pinion 410 is rotated additionally by only two rotations or less, more preferably, the pinion 410 is rotated additionally by only one rotation. This may prevent damage to the pinion 410 or the rack gear 611 caused when the pinion 410 is excessively rotated more than necessary.

Even when the pinion 410 is rotated one or two rotations, the pinion 410 or the rack gear 611 may be damaged.

However, considering that a packing member is provided between contact surfaces of the drawer 200 and the cabinet 100, even when the pinion 410 is rotated additionally by a buffering distance of the packing member, the pinion 410 and the rack gear 611 are not damaged. After that, when deactivation of the driving motor 420 operating the pinion 410 is performed, as the pinion 410 is reversibly rotated by additional rotation by a buffering force of the packing member and a movement force by excessive rotation, the opposite sides of the drawer 200 may be closed precisely without gear damage.

The guiding head 520 of the cable guide module 500 is a part coupled to the front panel 210.

An installation hole 212 may be provided on a center lower portion of the rear surface of the front panel 210 (referring to FIG. 10), and the guiding head 520 may pass partially into the installation hole 212, and may be coupled to the rear surface of the front panel 210.

Each of the connecting members 530 of the cable guide module 500 may connect the swinging connection member 540 and the guiding head 520 to be moveable.

The connecting member 530 may be configured as a hollow tubular body and may be connected to another connecting member 530 continuously. The cables may pass sequentially inside the connecting members 530 in order. The connection structure of the connecting member 530 may be a chain linkage structure.

A connected portion between each of the connecting members 530 may be provided to swing in a horizontal direction. A first end of the connecting member 530 may be connected to the swinging connection member 540 in a swinging manner, and a second end of the connecting members 530 may be connected to the guiding head 520 in a swinging manner. Through the structure, when the drawer 200 is moved forward and rearward, the connecting members 530 may move in conjunction with movement of the drawer 200 to move the cables.

The swinging connection member 540 of the cable guide module 500 may be rotatably connected to the cover plate 510.

A cable through-hole 515 may be provided on the cover plate 510 so that the cables pass therethrough, and the swinging connection member 540 may have a pipe structure and one end thereof is in close contact with an upper surface of the cover plate 510. On an end of the swinging connection member 540, an extension end 541 may have a dome structure extending gradually toward the end.

An extension hole 516 may be provided at a predetermined position on a circumference of the cable through-hole 515. On a circumference of the extension end 541 constituting the swinging connection member 540, a confining protrusion 542 may protrude outwards and pass through the extension hole 516.

The extension hole 516 may have a width through which only the confining protrusion 542 may pass. That is, as the confining protrusion 542 passes through the extension hole 516 and then a manipulation in which the swinging connection member 540 is partially rotated, the swinging connection member 540 may be maintained in a state of preventing separation from the cable through-hole 515 of the cover plate 510.

The mounting plate 550 (of the cable guide module 500) may prevent the swinging connection member 540 connected to the cover plate 510 from being separated from the cover plate 510.

The mounting plate 550 may be fixedly coupled to the cover plate 510, and may have a communicating hole 551 and a covering end 552. The communicating hole 551 is provided on a portion corresponding to the cable through-hole 515, and with the covering end 552 may protrude from a circumference of the communicating hole 551 to cover the extension end 541 of the swinging connection member 540. An inner surface of the covering end 552 may have the same spherical surface as an outer surface of the extension end 541 so that the covering end 552 and the extension end 541 are in close contact with each other.

The rack gear assemblies 601 and 602 of the refrigerator according to an embodiment of the present disclosure may be described.

The rack gear assemblies 601 and 602 are provided to allow the drawer 200 to be moved forward and rearward by a driving force of the driving part 400 provided in the cabinet 100.

The rack gear assemblies 601 and 602 may be respectively provided on opposite sides of the lower surface of the storage bin 220 constituting the drawer 200. As the rack gear assemblies 601 and 602 have rack gears 611 and 621 on lower surfaces thereof, the rack gear assemblies 600 are installed to be engaged with the pinions 410 that are exposed to the inside of the lower storage chamber 3.

The rack gears 611 and 621 (of the rack gear assemblies 601 and 602) extend from a front side of the lower surface of the storage bin 220 to a rear side thereof. Thus, the drawer 200 provided with the rack gear assemblies 601 and 602 may be pushed out and pushed in from the lower storage chamber 3 while being moved forward and rearward by rotation movement of the pinions 410.

The pinions 410 and the rack gear assemblies 601 and 602 may be respectively made in pairs of at least three pinions and at least three rack gear assemblies.

As an automatic pushing-out distance of the storage bin 220 is increased, usability of the drawer 200 may improve.

That is, as a storage space in the storage bin 220 is maximally moved in the opposite direction from the lower storage chamber 3, the drawer 200 may be provided such that it is easy to store the container 240 in the storage bin 220, or to store items and food in the storage space.

The container 240 may be automatically raised by the raising/lowering module 300 when the drawer 200 is opened. Thus, it is preferable that the storage bin 220 is maximally separated from the lower storage chamber 3.

The two pinions 410 may be positioned on a portion of the front side of the lower storage chamber 3, and lengths of the rack gears 611 and 621 may be maximally long.

That is, as the two pinions 410 are positioned close to a portion of the front side of the lower storage chamber 3 and the rack gears 611 and 621 have the long lengths, the pushing-out distance of the storage bin 220 may increase.

A front to rear length of the lower surface of the storage bin 220 may be shorter than that of an open upper surface of the storage bin 220. In view of that, the rack gears 611 and 621 may have limited lengths.

Accordingly, the rack gear assemblies 600 according to an embodiment may be configured to extend in lengths thereof, thereby increasing the pushing-out distance of the storage bin 220.

That is, even when the front to rear length of the storage bin 220 is short, lengths of the rack gear assemblies 601 and 602 extend, thereby allowing the storage bin 220 to be farther pushed out.

Therefore, in an embodiment of the present disclosure, the rack gear assemblies 601 and 602 may include a first rack member 610 (or first rack) and a second rack member 620 (or second rack), a first rack cover 614, a second rack cover 624, the idle gear 630, the confining protrusion part 650, and a confining module 670 that are pushed out while being moved forward in order.

The rack gear assembly 600 may be described in detail by each part as follows.

The first rack member 610 (or first rack) may perform forward and rearward movement of the storage bin 220 by rotation of the pinion 410, and the first rack member 610 may have a rack gear 611.

The first rack member 610 may be provided such that an upper surface thereof is fixed to the lower surface of the storage bin 220 while being in close contact thereto. A plurality of coupling holes 612 may be provided on the first rack member 610, and the first rack member 610 may be attached to the storage bin 220 by screw fastening (or other connections) through the coupling holes 612.

The second rack member 620 (or second rack) may be at a lower surface of the first rack member 610, and thus the first rack member 610 may have a movement guiding groove 613 that is formed in a depressed manner and supports sliding movement of the second rack member 620.

The movement guiding groove 613 may be provided in the depressed manner from a front end portion of the first rack member 610 and formed by penetrating through a rear surface of the first rack member 610. That is, the second rack member 620 received at the movement guiding groove 613 may be exposed to the rear of the movement guiding groove 613.

The rack gear 611 of the first rack member 610 may be provided on any one side (one side in the opposite direction between two rack gear assemblies) of the movement guiding groove 613 along a longitudinal direction of the first rack member 610 in which the rack gear 611 is included.

The rack gear 611 may be further forward than the movement guiding groove 613.

The first rack member 610 may include a first rack cover 614.

The movement guiding groove 613 provided in the first rack member 610 has an inside portion that is open vertically so that a holder 672 and a locking member 673 (or latch), which are included in the confining module 670, may pass through the movement guiding groove 613. The first rack cover 614 may cover the upper surface of the first rack member 610 by being coupled thereto, so that a lower surface of the first rack cover 614 covers an open portion of the movement guiding groove 613 provided on the first rack member 610, and may be provided as an upper surface of the movement guiding groove 613.

The first rack cover 614 may be formed of a metal plate to reinforce insufficient strength of the first rack member 610.

The lower surface (upper surface in the movement guiding groove) of the first rack cover 614 may include receiving grooves 614*a* and 614*b* in which the holder 672 and the locking member 673 of the confining module 670 are respectively received.

The receiving grooves 614*a* and 614*b* may include a first receiving groove 614*a* for receiving the holder 672 and a second receiving groove 614*b* for receiving the locking member 673. The two receiving grooves 614*a* and 614*b* may be spaced apart from each other in a moving direction of the first rack member 610. A spaced distance between a rear surface of the first receiving groove 614*a* and a rear surface of the second receiving groove 614*b* may be longer than a spaced distance between a rear surface of the holder 672 and a rear surface of the locking member 673.

The receiving grooves 614*a* and 614*b* are configured such that the holder 672 is firstly received into the first receiving groove 614*a* and then the locking member 673 is received into the second receiving groove 614*b*.

Unlike the above-described embodiment, the first rack cover 614 and the first rack member 610 may be provided as a single body through an injection molding manner.

However, when the first rack member 610 and the first rack cover 614 are configured as the single body, it may be difficult for the injection molding thereof. That is, the first rack member 610 and the first rack cover 614 are different in shapes and directions at uneven portions thereof, so that the injection molding thereof may be difficult.

Accordingly, as shown in the embodiment, the first rack member 610 and the first rack cover 614 may be separately manufactured and then coupled to each other.

The second rack member 620 may perform the forward and rearward movement of the storage bin 220 together with the first rack member 610.

The second rack member 620 may be inserted in the movement guiding groove 613 of the first rack member 610. When the first rack member 610 is moved by a preset distance, the second rack member 620 is moved forward by leading of the first rack member 610 and may receive rotational force of the pinion 410. As the second rack member 620 is continuously moved forward by the rotational force of the pinion 410, the first rack member 610 is further pushed out even when the rack gear 611 of the first rack member 610 is separated from the pinion 410.

The first rack member 610 may lead the second rack member 620 through a linkage part 680 so that the second rack member 620 is moved.

The linkage part 680 may include a linkage protrusion 681 and a linkage step 682, where the linkage protrusion 681 is provided on the lower surface (lower surface in the movement guiding groove) of the first rack cover 614 and the linkage step 682 is provided on an upper surface of the second rack member 620. When the first rack member 610 is moved forward by the preset distance, the linkage protrusion 681 and the linkage step 682 are in contact with each other to perform forward movement of the second rack member 620.

The linkage protrusion 681 may also be provided on the first rack member 610. The linkage protrusion 681 may also be provided on the upper surface of the second rack member 620 and the linkage step 682 may be provided on a lower surface of the first rack member 610.

When the second rack member 620 is fully inserted into the movement guiding groove 613 of the first rack member 610, a spaced distance between the linkage protrusion 681 and the linkage step 682 is configured as a distance that is set such that the first rack member 610 is moved forward without affecting the second rack member 620. The preset distance may be determined based on a size or a total pushing-out distance of the storage bin 220.

The second rack member 620 may be provided with a rack gear 621. The rack gear 621 is formed alongside a side portion of the rack gear 611 of the first rack member 610. A front end of the rack gear 621 is provided to be further rearward than a front end of the rack gear 611 of the first rack member 610, and a rear side end thereof may further extend to the rear side than a rear side end of the rack gear 611 of the first rack member 610.

The rack gears 611 and 621 of the first rack member 610 and the second rack member 620 may easily receive the driving force of the pinions 410, respectively. That is, since the pinions 410 are formed to have the width that is a size of adding a width of the rack gear 611 of the first rack member 610 and the rack gear 621 of the second rack member 620, each of the rack gears 611 and 621 may efficiently receive the driving force of the pinions 410.

A motion groove 622 may be provided on a front lower surface of the second rack member 620 in a depressed manner. The motion groove 622 may provide a motion space in which a stopper member 671 of the confining module 670 is moved forward and rearward in a mounted state.

The motion groove 622 may be provided with a plurality of through holes 622*a* and 622*b* in an upward penetrating manner. The through holes 622*a* and 622*b* may include a first through hole 622*a* through which the holder 672 passes and a second through hole 622*b* through which the locking member 673 passes. The holder 672 and the locking member 673 are included in the confining module 670 and may be described below.

The second through hole 622*b* may be formed as a horizontally long hole so that forward and rearward movement of the locking member 673 may be performed.

A second rack cover 624 may be provided at a lower surface of the second rack member 620. The second rack cover 624 may cover the lower surface of the second rack member 620.

The second rack cover 624 may prevent the stopper member 671, mounted to the motion groove 622 (of the second rack member 620) from being separated to the outside.

The second rack cover 624 may be formed of a metal plate and may cover the lower surface of the second rack member 620. Thus, deformation such as torsion or bending of the second rack member 620 may be prevented. The second rack cover 624 may be provided with a partially open portion for reducing the weight thereof.

The second rack cover 624 may be provided with folded ends 624*a* in a folded manner on opposite side surfaces and a rear surface thereof. The folded ends 624*a* cover parts of the opposite side surfaces and the rear surfaces of the second rack member 620 to prevent flexural deformation of the second rack member 620.

The second rack cover 624 may include a stopper exposure hole 624*b* on a front end portion thereof, and the stopper member 671 may be partially exposed through the stopper exposure hole 624*b*.

The idle gear 630 is provided so that the opposite sides of the drawer 200 are fully closed even when the drawer 200 is closed obliquely instead of horizontally.

The idle gear 630 may include a gear that is configured to be engaged with the pinion 410 and to allow the pinion 410 to idle. The idle gear 630 may be provided at any one rack gear assembly of the rack gear assemblies 601 and 602.

In an embodiment of the present disclosure, the idle gear 630 is provided only at the rack gear assembly 602 (hereinafter referred to as release rack gear assembly) that is positioned on a right side when the drawer 200 is viewed from the bottom.

Although not shown, the idle gear 630 may be provided at the left side rack gear assembly 601 (hereinafter referred to as general rack gear assembly).

However, considering that the driving motor 420 constituting the driving part 400 is operated such that the rack gear assembly is further moved by a predetermined distance when closing of the drawer 200 is sensed, even when the idle gear 630 is provided in either side, the opposite sides the drawer 200 may be closed horizontally.

Figure 11:
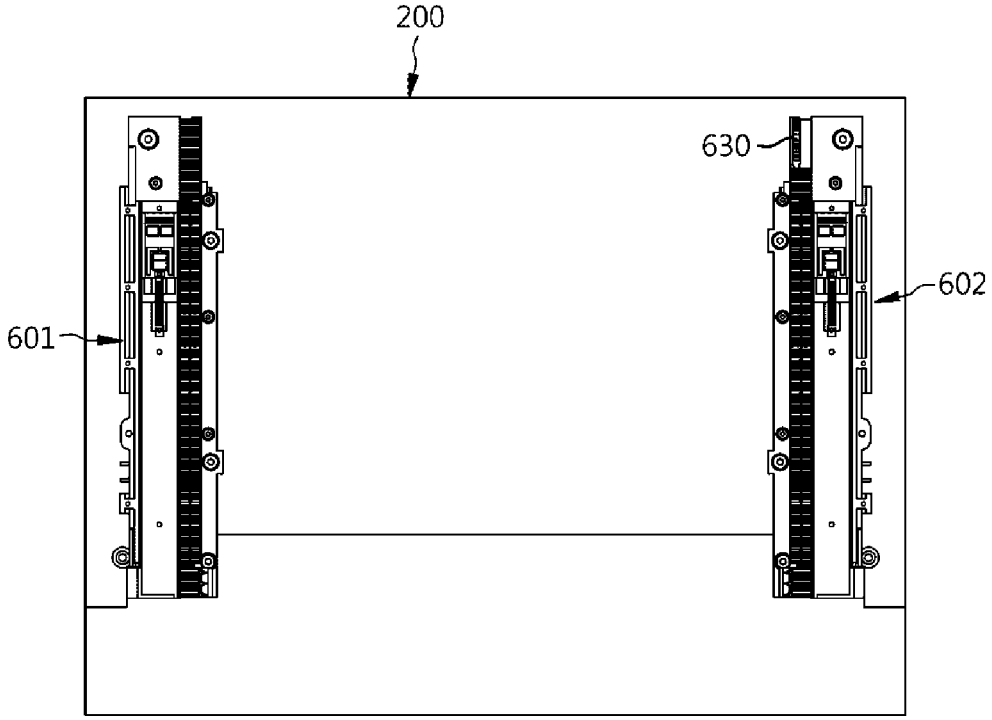
FIG. 11 is a bottom view of the refrigerator showing a state in which a rack gear assembly is installed therein.
Figure 12:
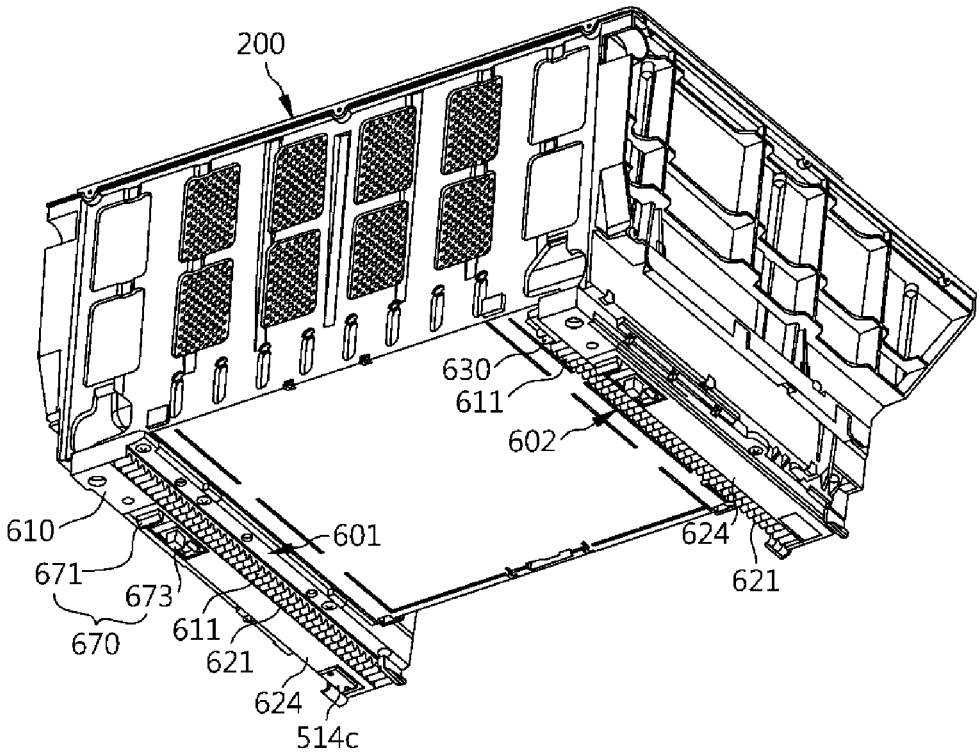
FIG. 12 is a perspective view showing the rack gear assembly according to the embodiment of the present disclosure is installed in the refrigerator, the view being taken at a lower portion thereof.
Figure 13:
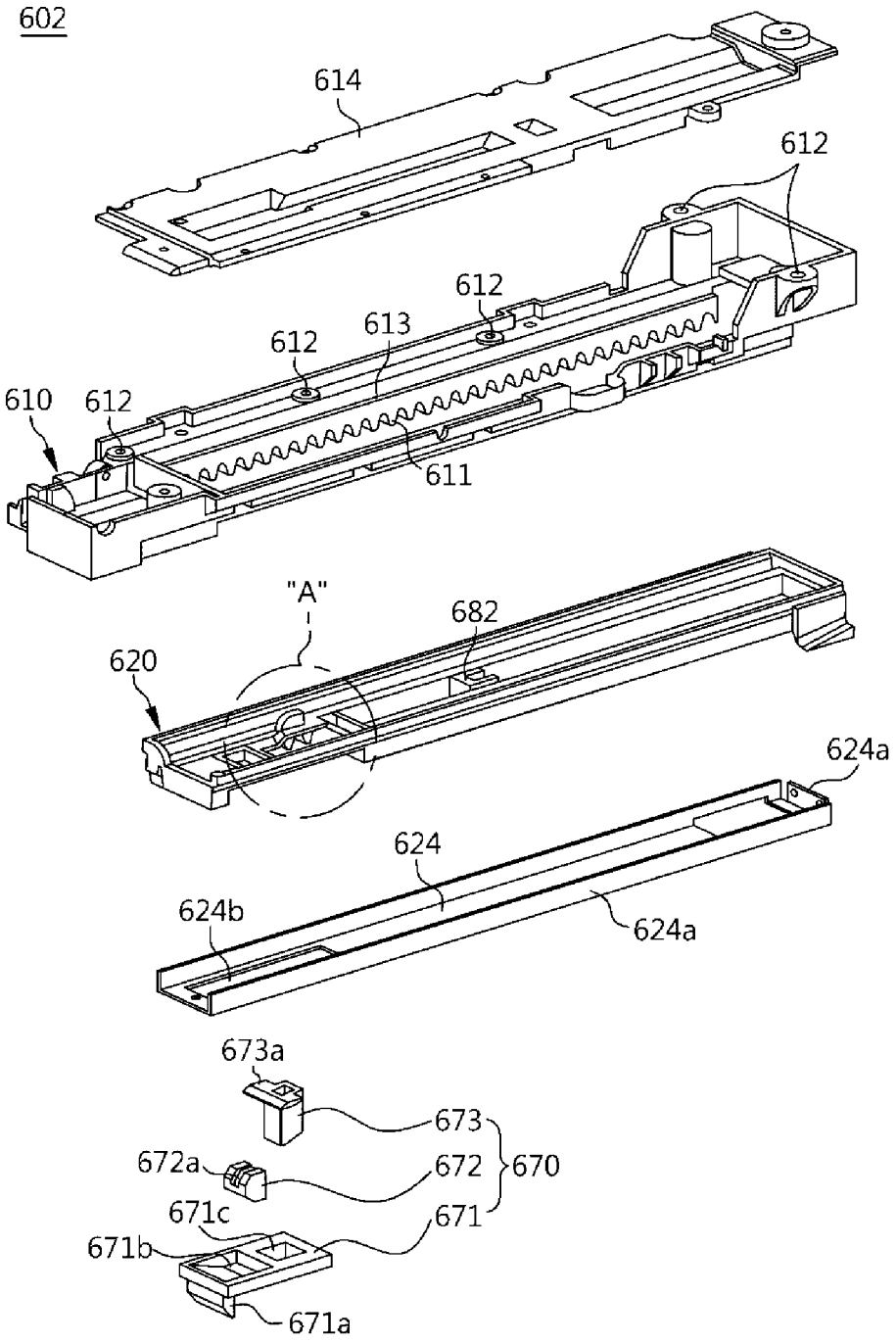
FIG. 13 is an exploded-perspective view showing the rack gear assembly of the refrigerator from above.
Figure 14:
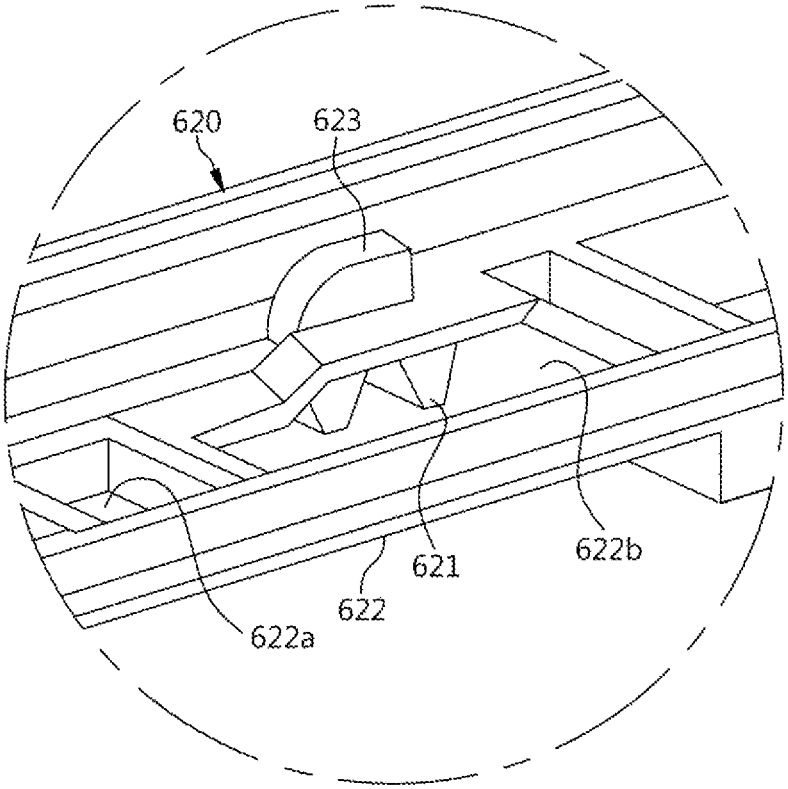
FIG. 14 is an enlarged view of "A" part in FIG. 13.
Figure 15:
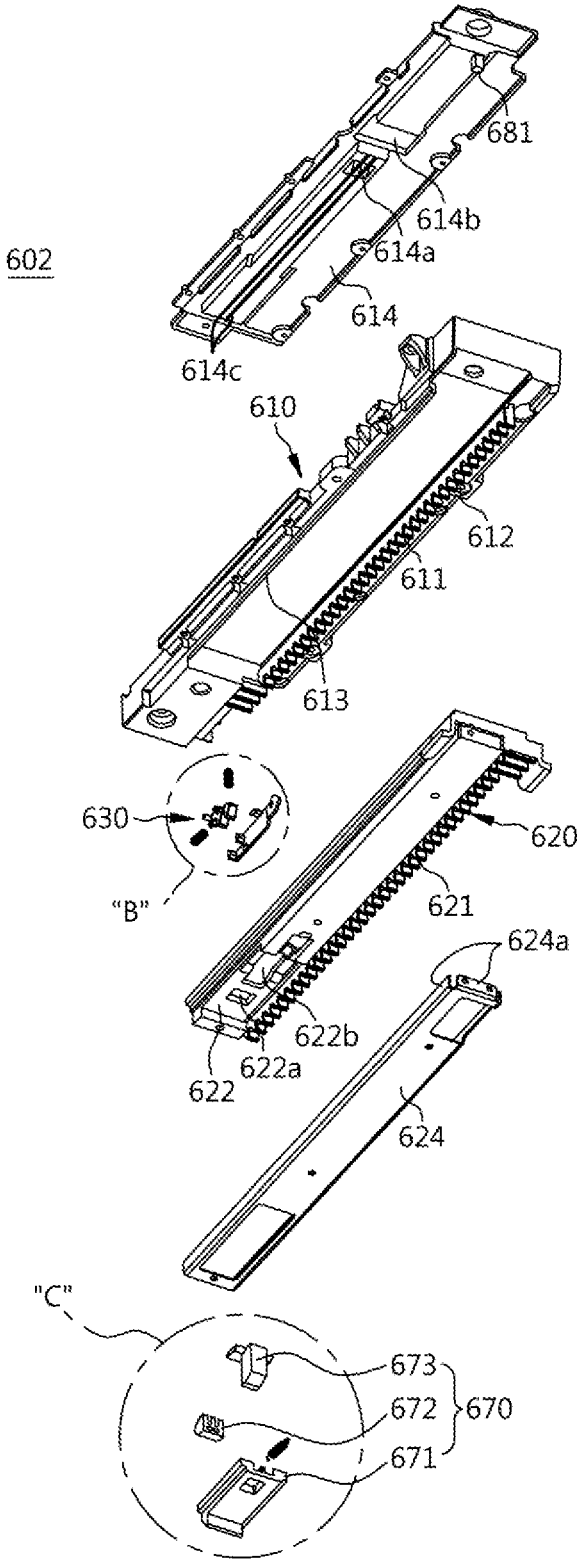
FIG. 15 is an exploded-perspective view from the bottom, the view showing the rack gear assembly according to the embodiment of the present disclosure.
Figure 16:
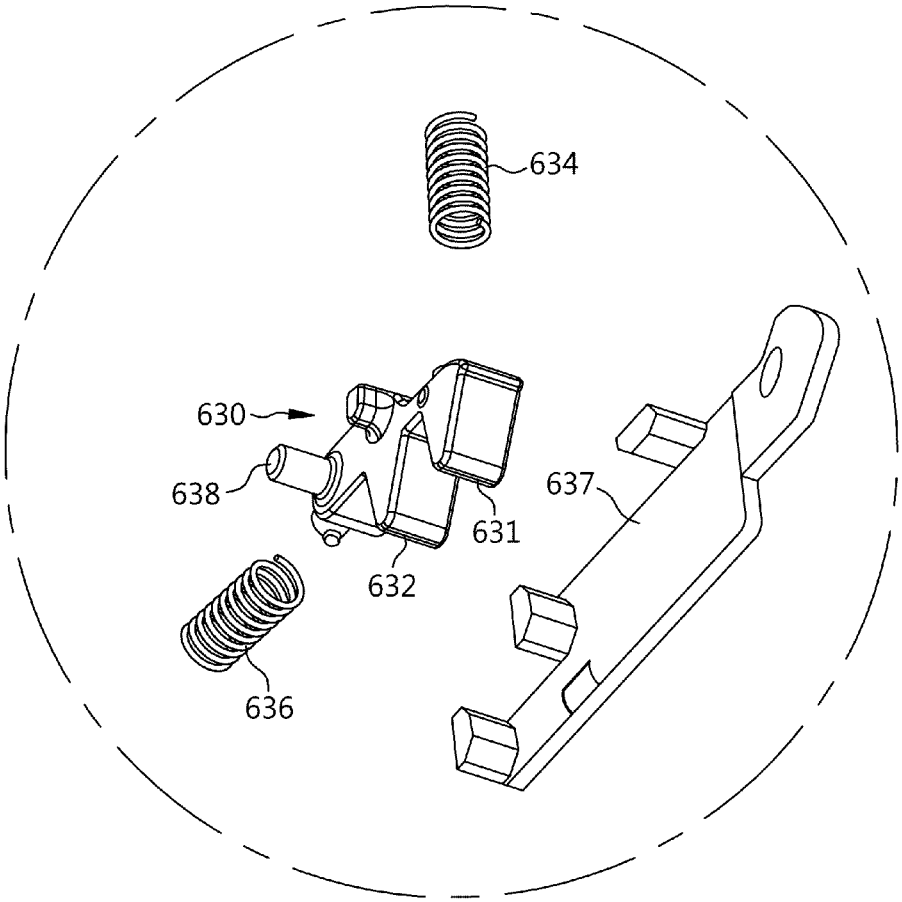
FIG. 16 is an enlarged view of "B" part in FIG. 15 for showing an idle gear of the refrigerator according to the embodiment of the present disclosure.
Figure 17:
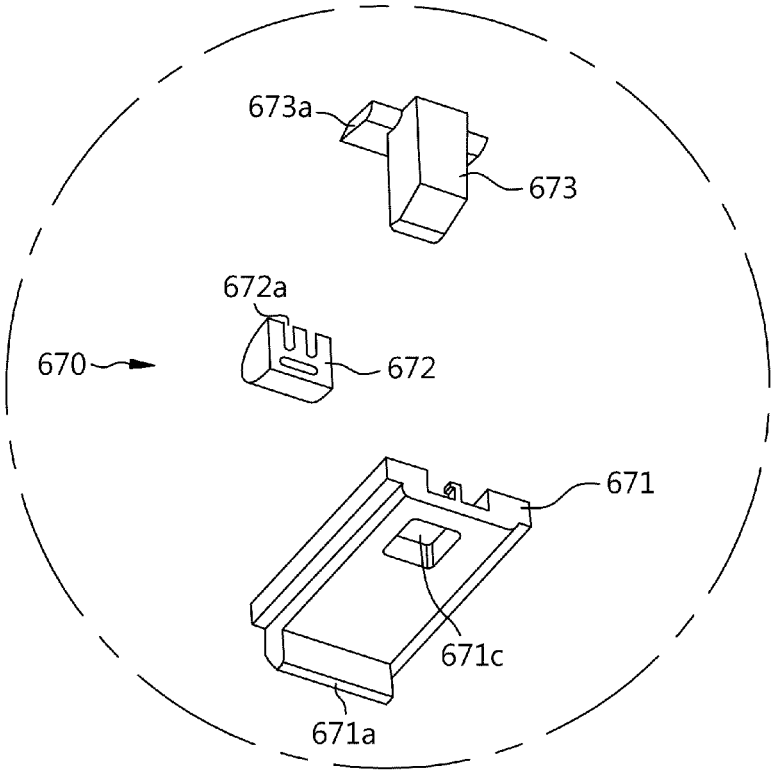
FIG. 17 is an enlarged view of "C" part in FIG. 15, the view showing a confining module of the refrigerator according to the embodiment of the present disclosure.
Figure 18:
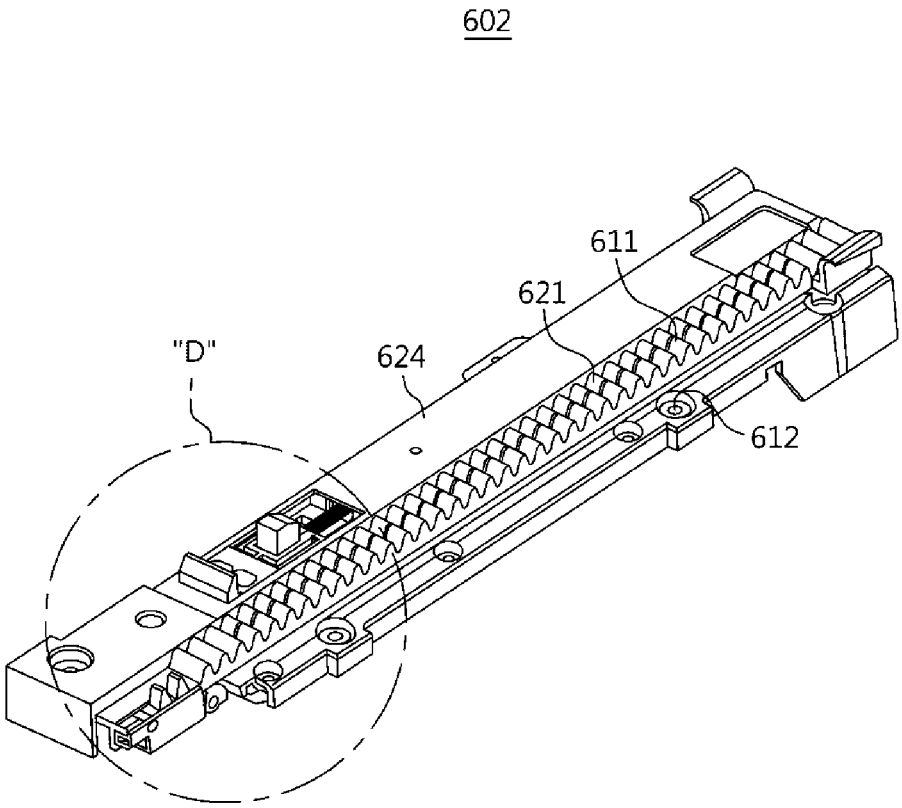
FIG. 18 is a perspective view showing the rack gear assembly being overturned for showing a lower surface structure thereof.
Figure 19:
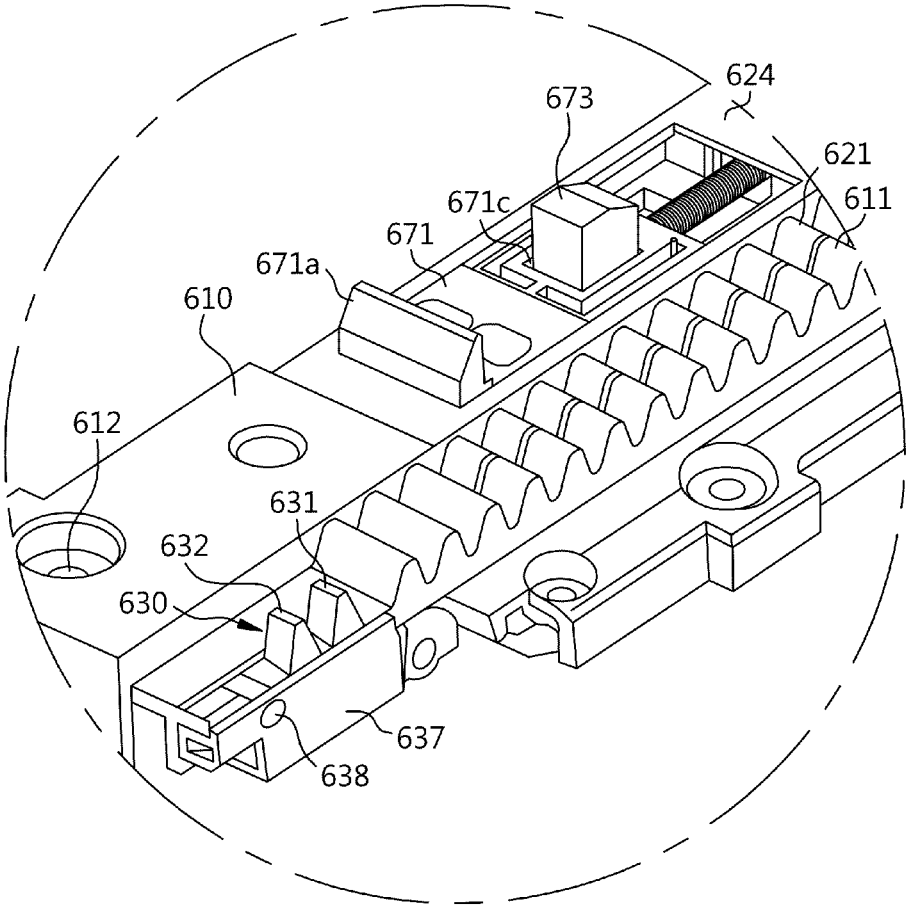
FIG. 19 is an enlarged view of "D" part in FIG. 18.
Figure 20:
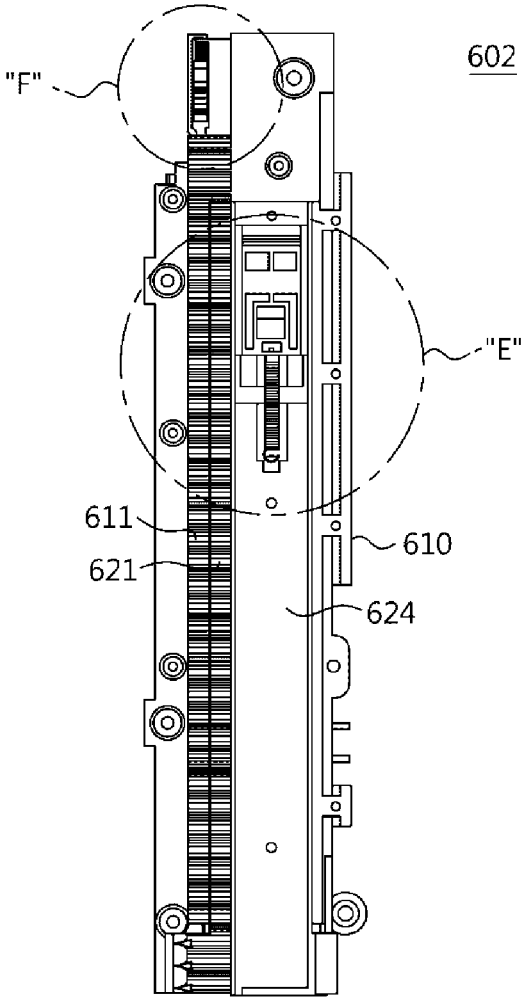
FIG. 20 is a bottom view showing the lower surface structure of the rack gear assembly of the refrigerator according to the embodiment of the present disclosure.
Figure 21:
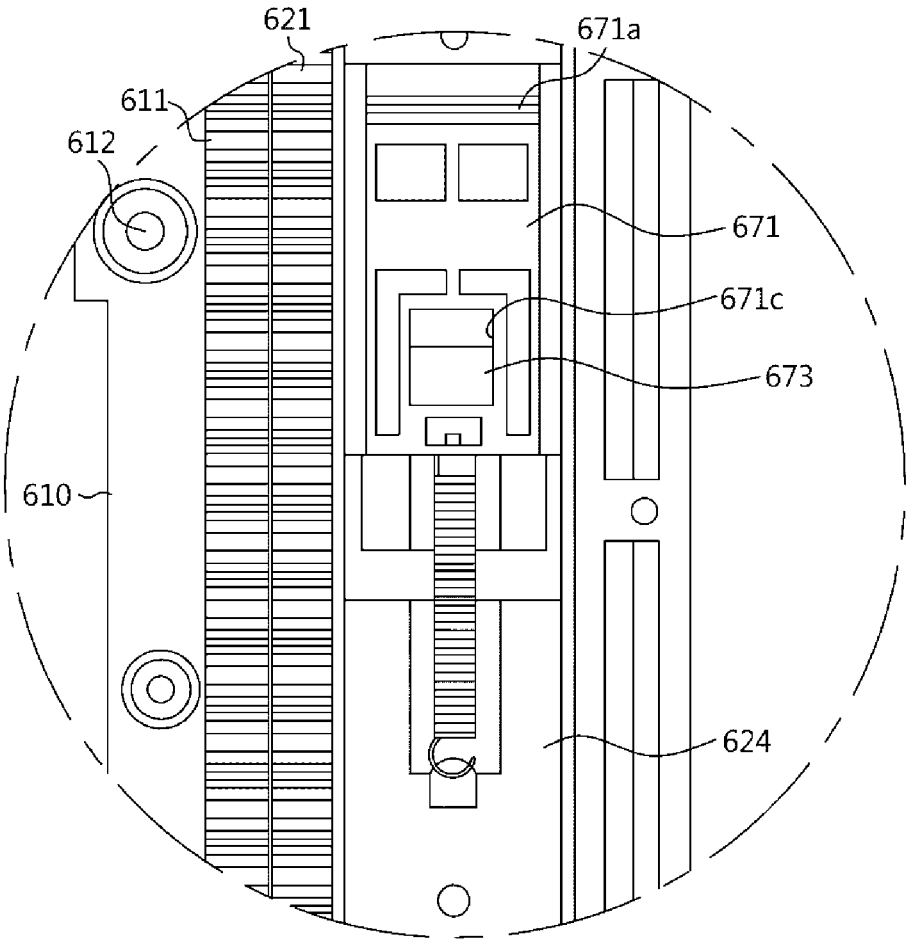
FIG. 21 is an enlarged view of "E" part in FIG. 20.
Figure 22:
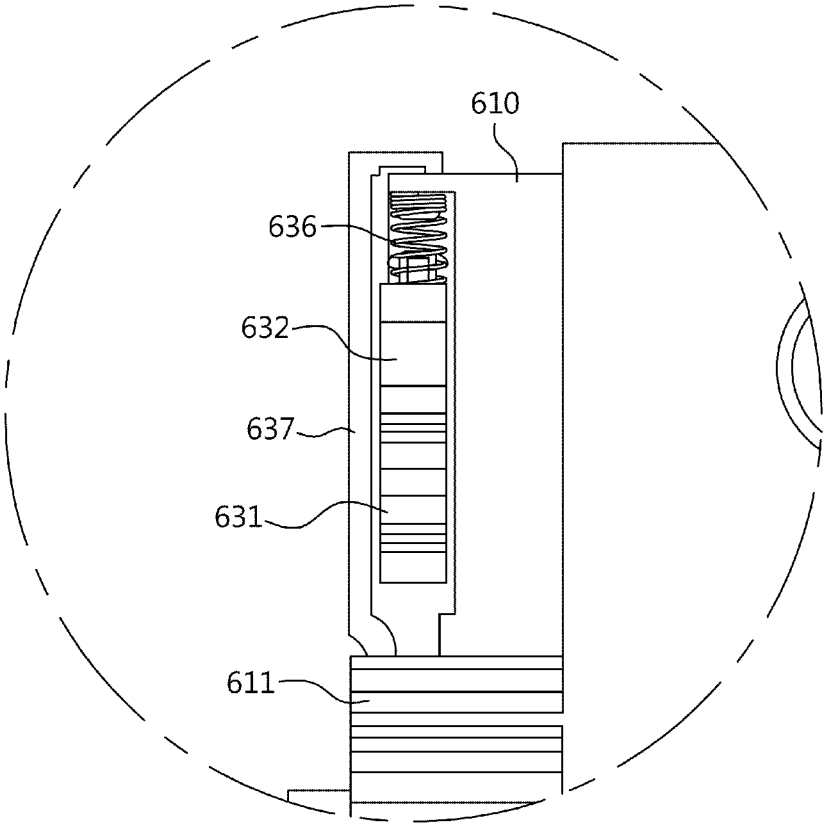
FIG. 22 is an enlarged view of "F" part in FIG. 20.
Figure 23:
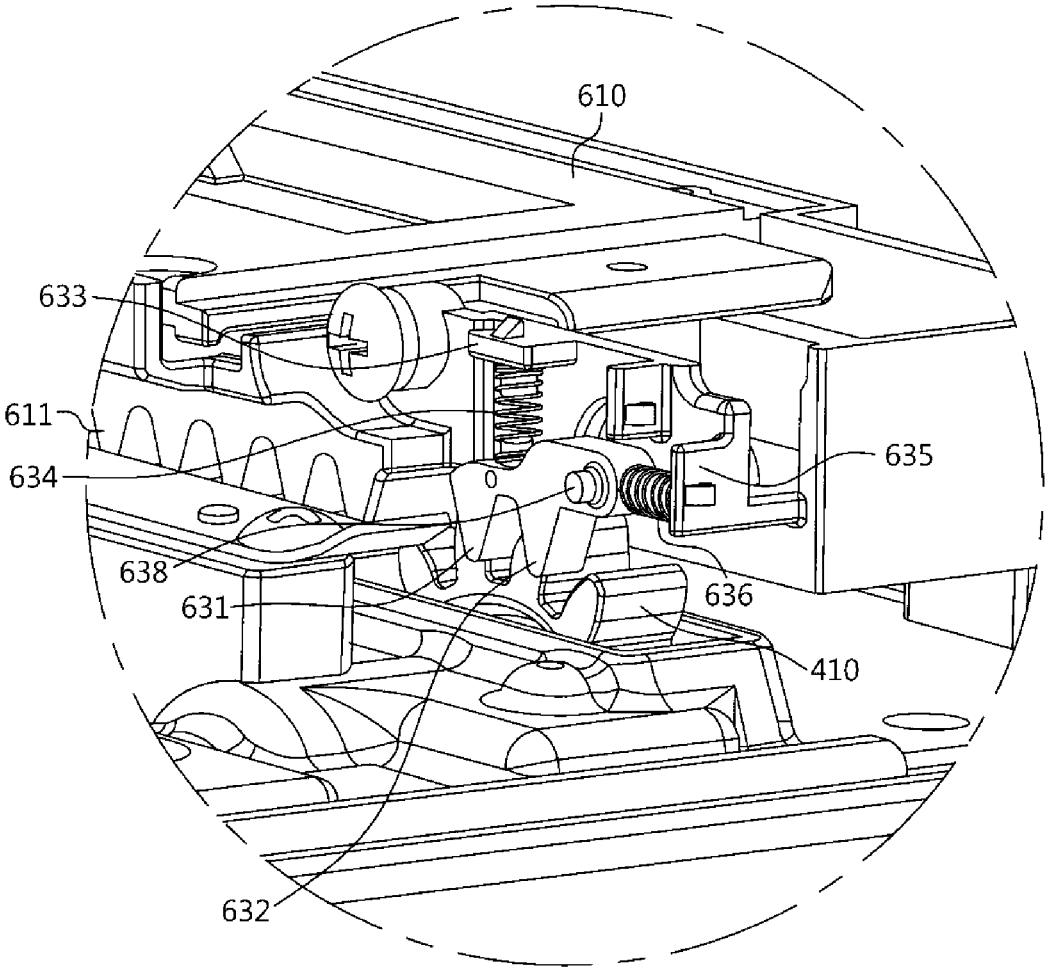
FIG. 23 is a main part perspective view showing installation of the idle gear of the refrigerator according to the embodiment of the present disclosure.
Figure 24:
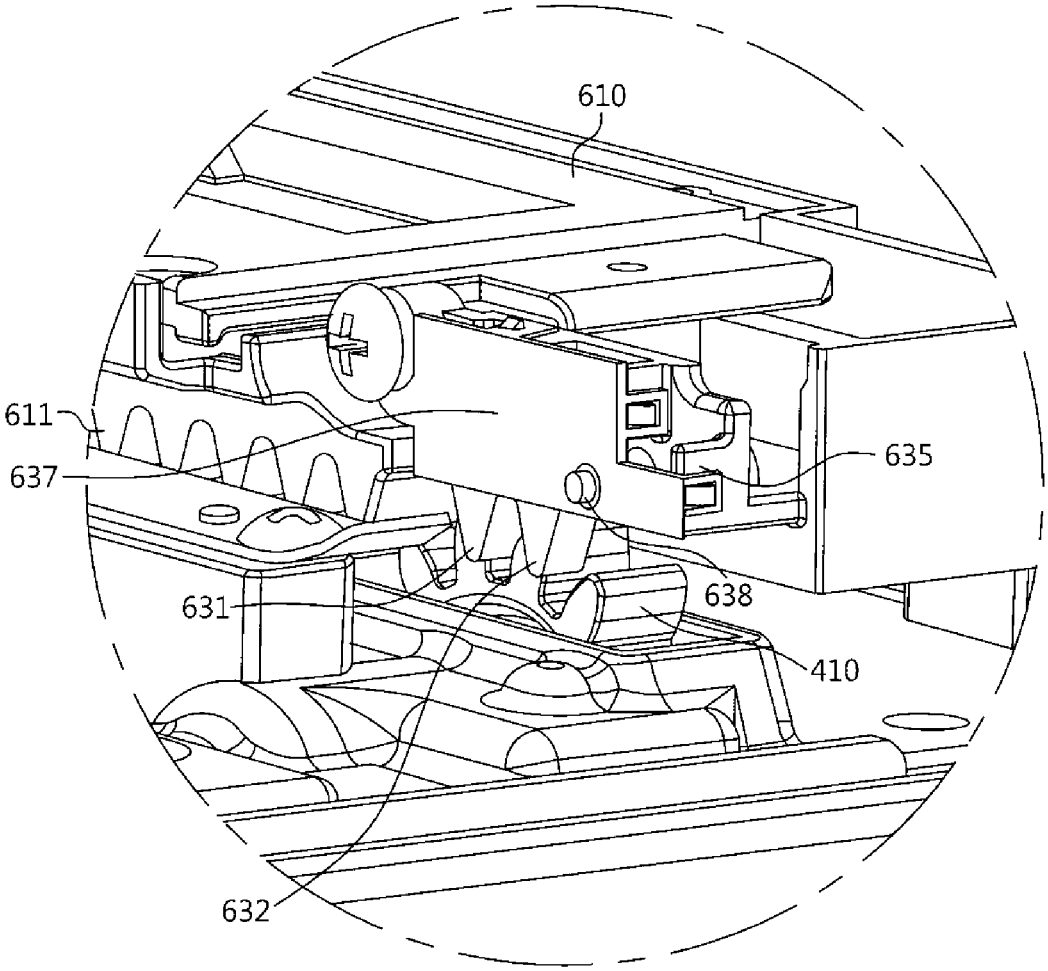
FIG. 24 is a main part perspective view showing installation of a cover body in FIG. 23.
Figure 25:
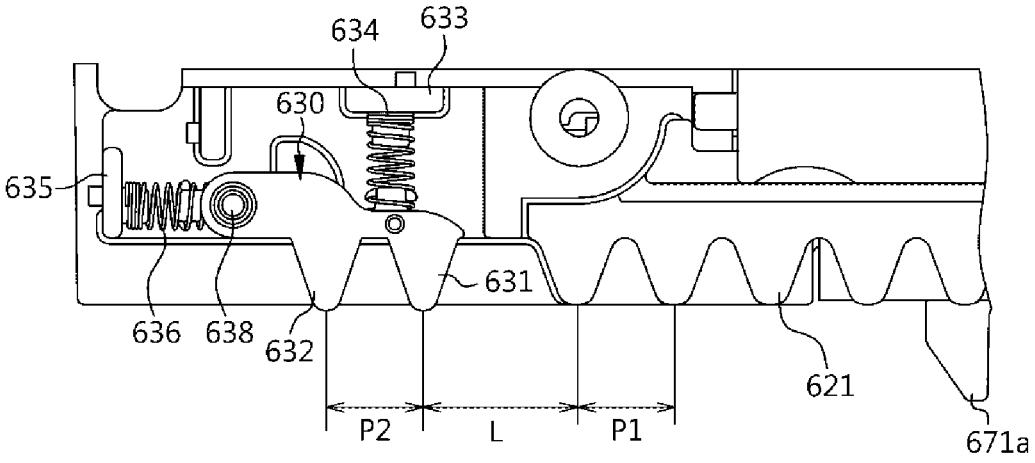
FIG. 25 is a main part side view showing installation of the idle gear of the refrigerator according to the embodiment of the present disclosure.
Figure 26:
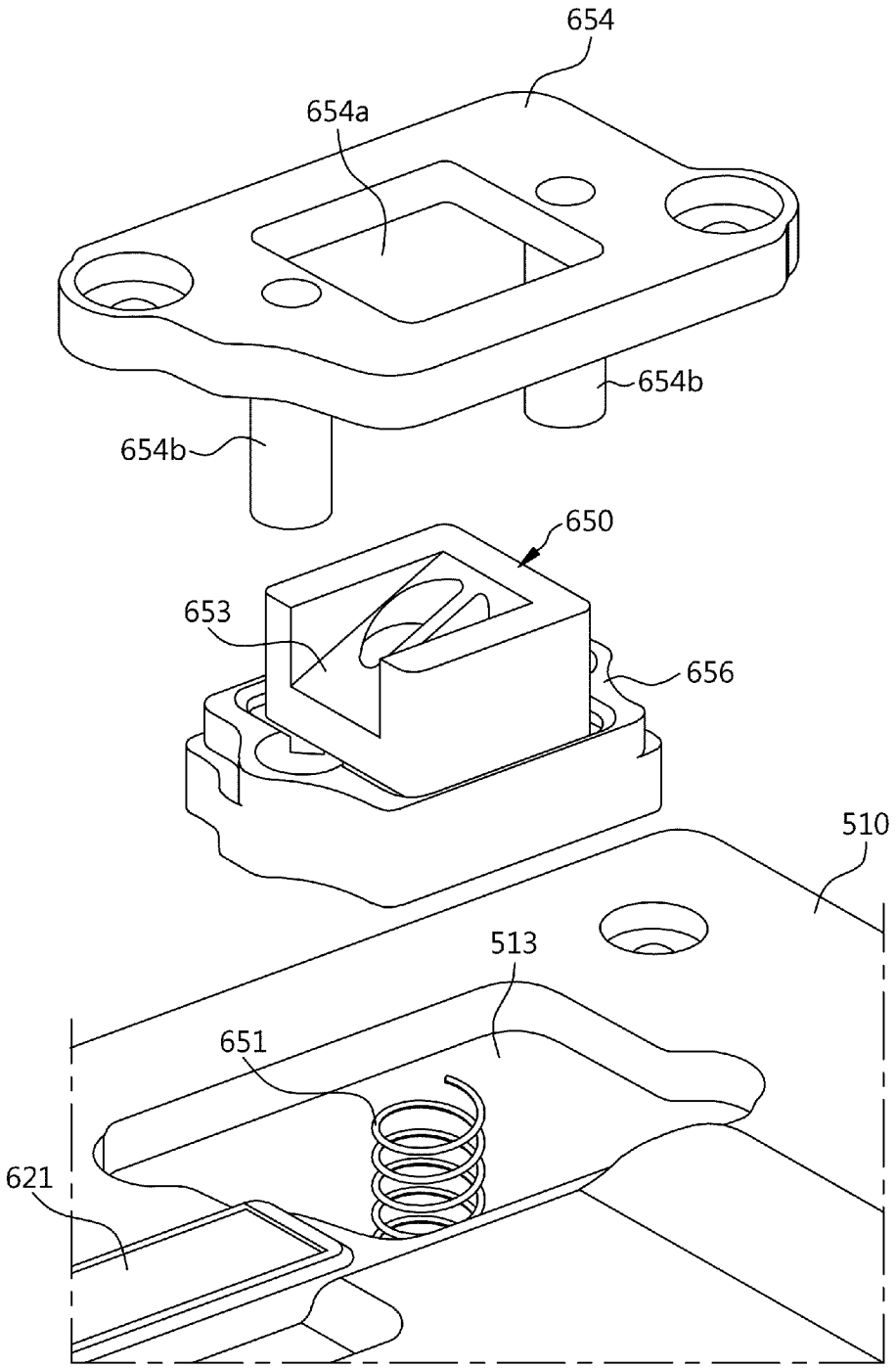
FIG. 26 is an exploded-perspective view showing a confining protrusion part of the refrigerator according to the embodiment of the present disclosure.
Figure 27:
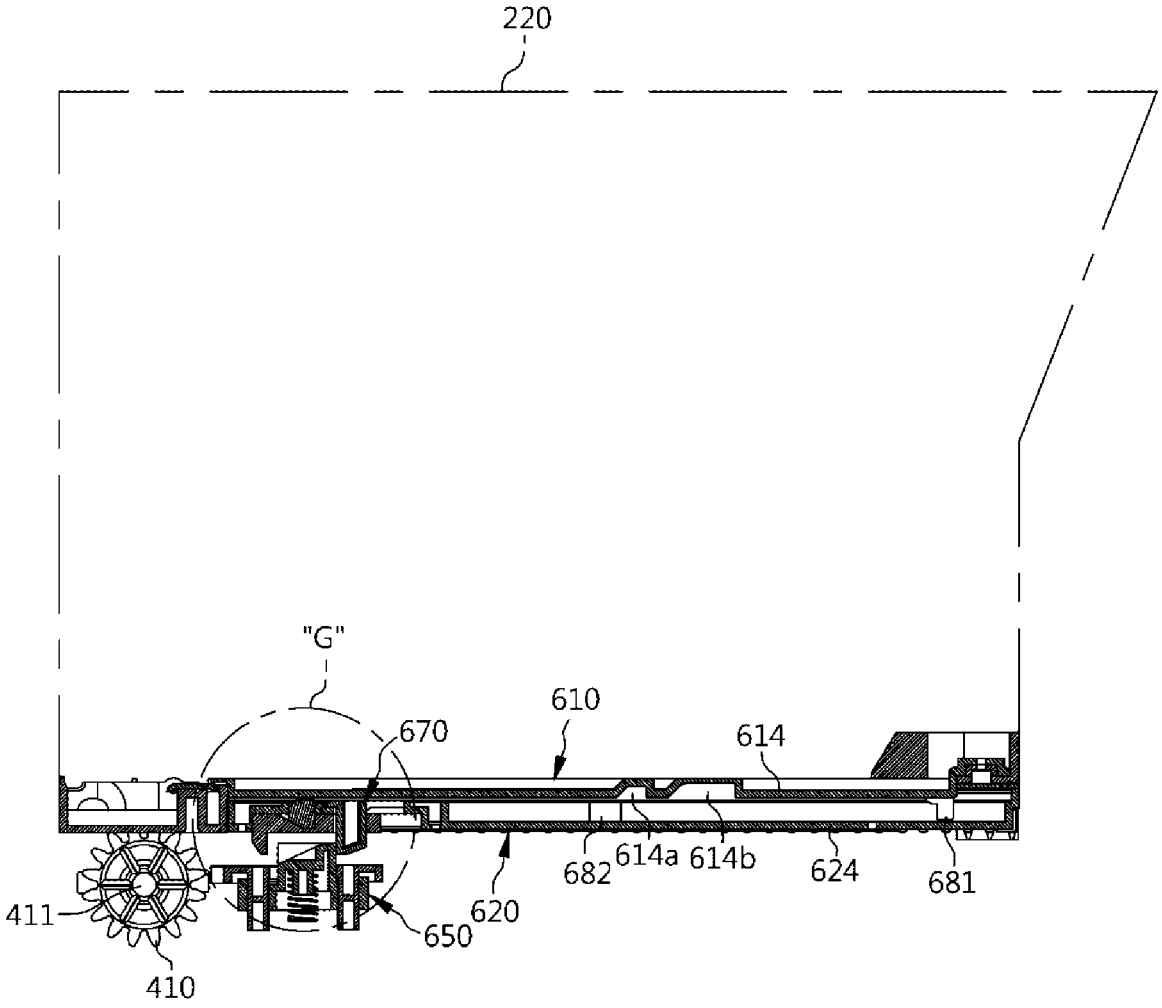
FIGS. 27, 29, 31, and 33 are views showing operational states of the rack gear assembly during a process of opening the storage bin of the refrigerator according to the embodiment of the present disclosure.
Figure 28:
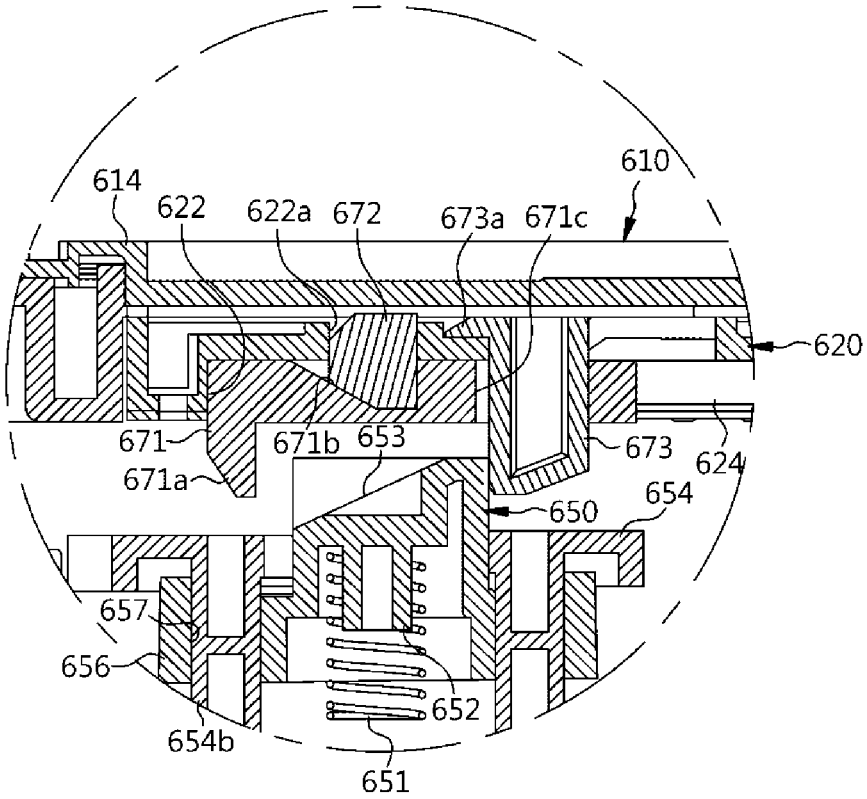
FIG. 28 is an enlarged view of "G" part in FIG. 27.
Figure 29:
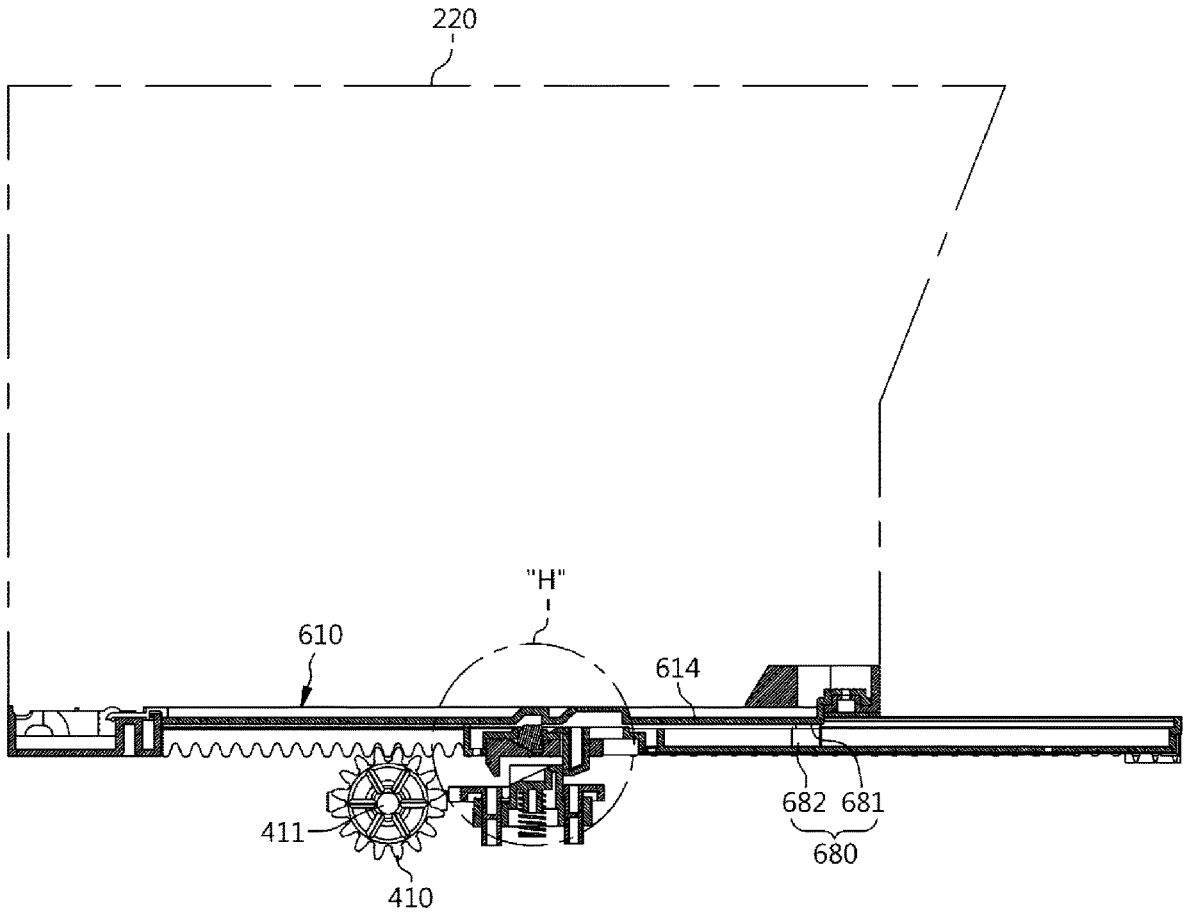
Figure 30:
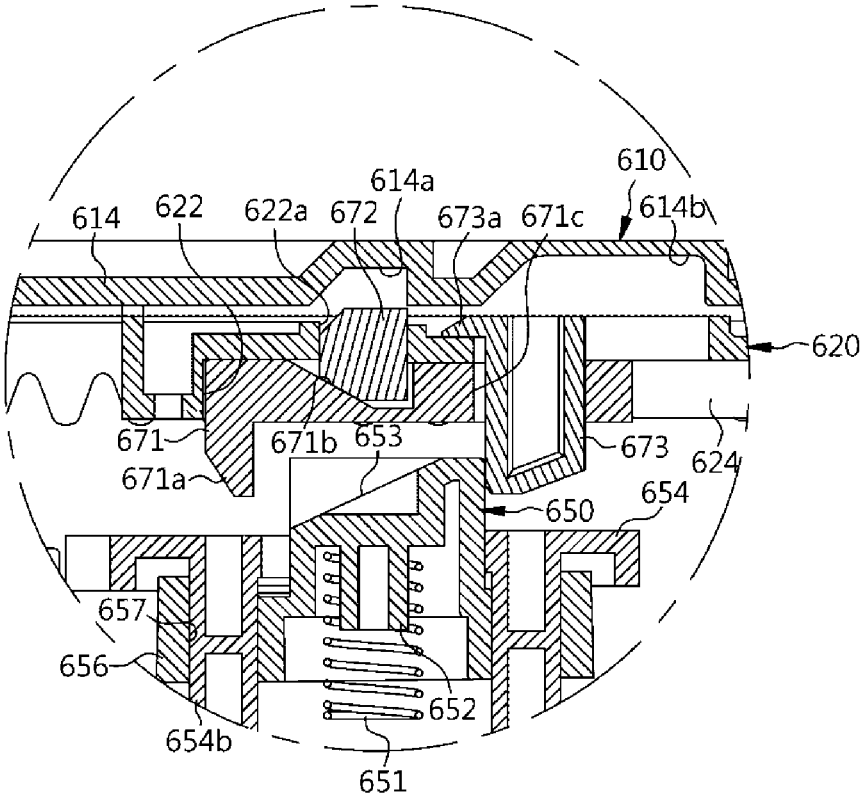
FIG. 30 is an enlarged view of "H" part in FIG. 29.
Figure 31:
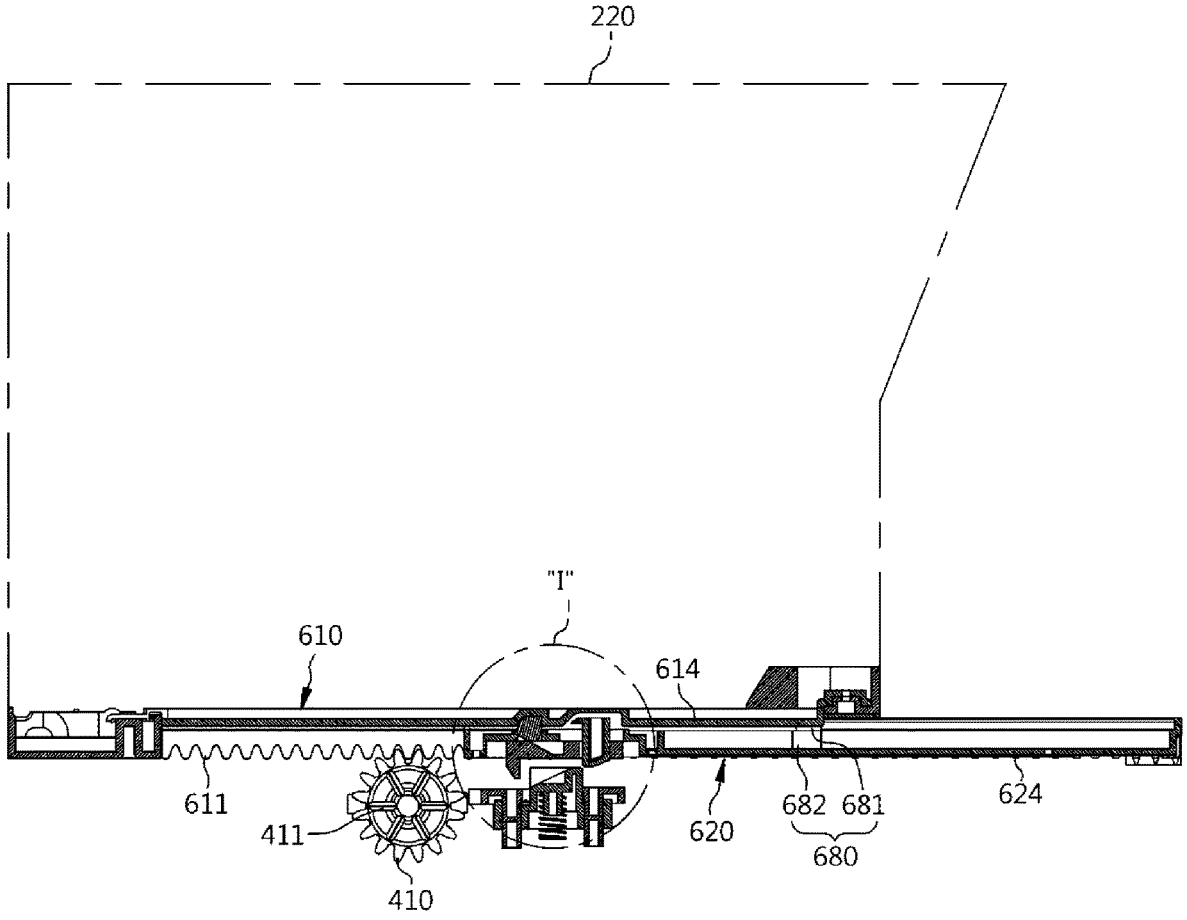
Figure 32:
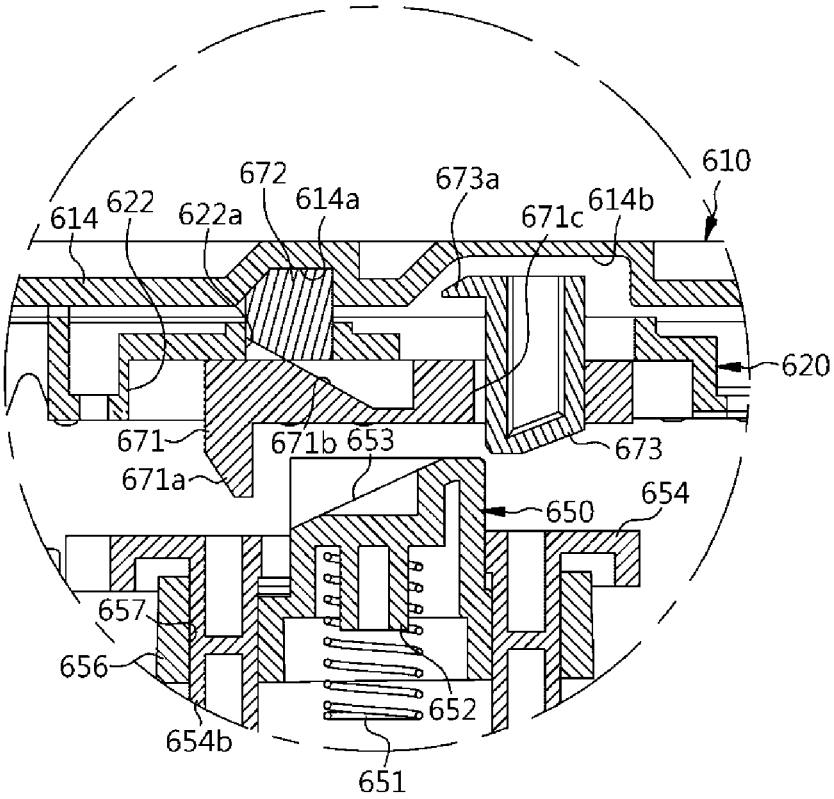
FIG. 32 is an enlarged view of "I" part in FIG. 31.
Figure 33:
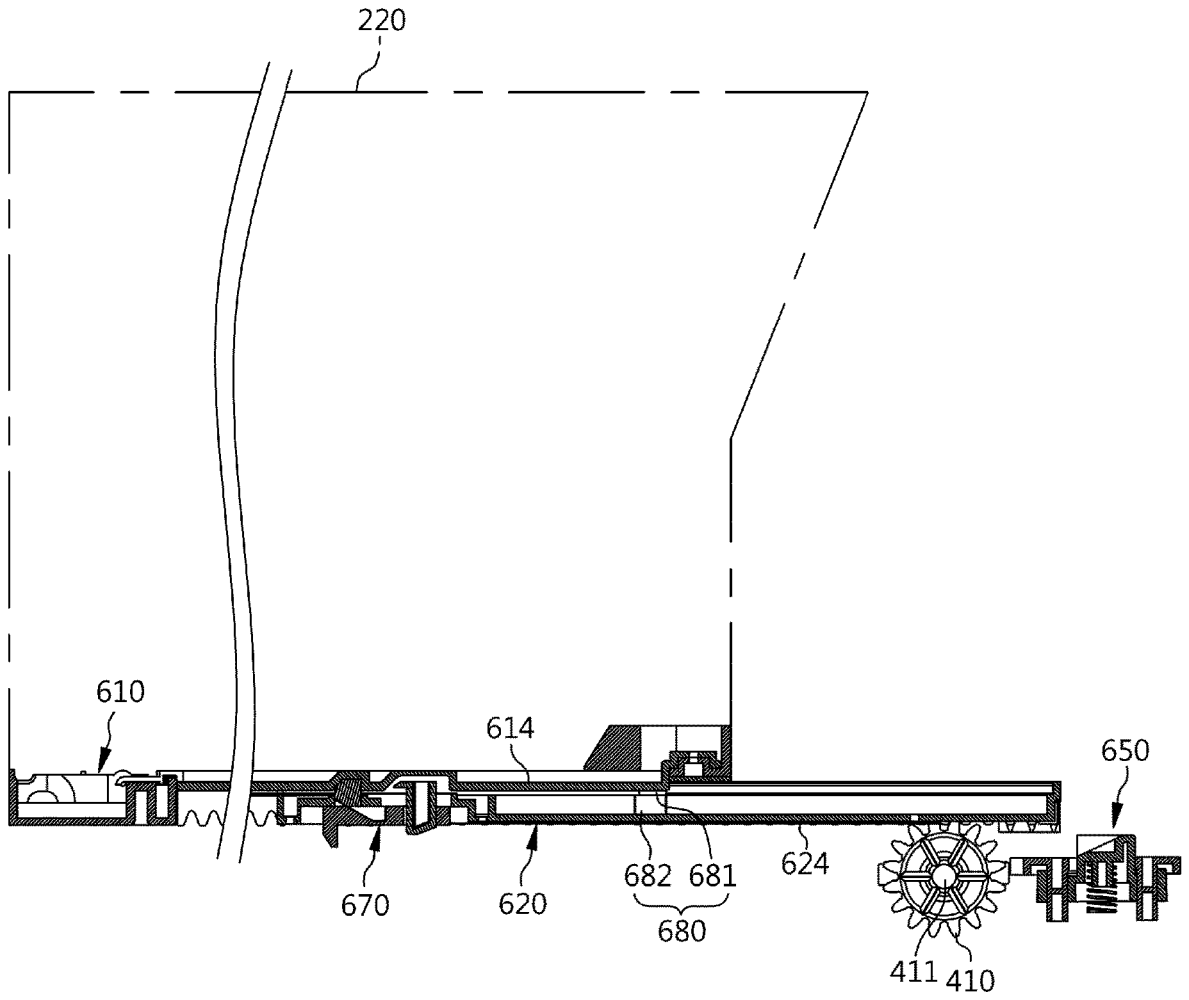
Figure 34:
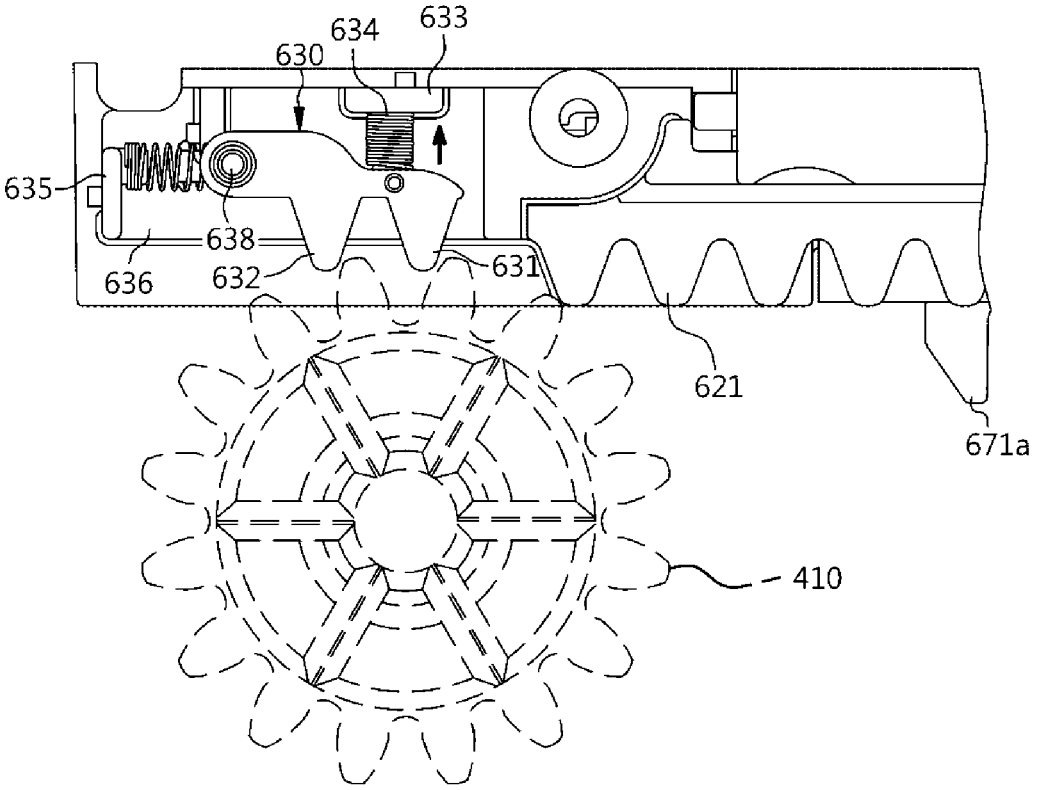
FIG. 34 is a view showing schematically position compensation by the idle gear when the drawer of the refrigerator according to the embodiment of the present disclosure is closed.

The two rack gear assemblies 601 and 602 may be configured as follows. In the general rack gear assembly provided at a portion where the open/close sensing part 514 is positioned, the rack gear 611 of the first rack member 610 is formed continuously to a front end of the first rack member 610. On the other side, in the release rack gear assembly, the rack gear 611 of the first rack member 610 is not formed to a front end of the first rack member 610 and is formed relatively shorter than the rack gear 611 of the general rack gear assembly, and the idle gear 630 is provided in front of the release rack gear assembly, as shown in FIG. 11.

That is, the idle gear 630 may be provided at the position where the idle gear 630 is engaged with the pinion 410 when the drawer 200 is in the closed state.

The idle gear 630 has at least one gear tooth 631 and 632 (referring to FIGS. 16, 19, and 22 to 25). The gear tooth may be engaged with the gear teeth of the pinion 410.

The idle gear 630 may have two gear teeth 631 and 632, and the two gear teeth 631 and 632 has a pitch p2 same as the pitch P1 of the rack gear 611. That is, the idle gear 630 may be formed in the substantially same structure as the rack gear 611 of the first rack member 610 and to be engaged with the pinion 410.

A spaced distance L between the rack gear 611 and a rear side gear tooth 631, which is positioned relatively close to the rack gear 611, of the two gear teeth 631 and 632 of the idle gear 630 may be formed longer than a pitch of each gear tooth (pitch between gear teeth of idle gear or pitch between gear teeth of rack gear).

Even when the release rack gear assembly provided with the idle gear 630 is pushed into the storage chamber relatively less than the general rack gear assembly of the other side (normally one pitch), the gear teeth 631 and 632 of the idle gear 630 are engaged with the pinion 410, thereby being pulled by the distance difference. Thus, the release rack gear assembly may be positioned alongside the general rack gear assembly while performing the forced forward movement thereof.

When the spaced distance L between the gear teeth 631 and 632 of the idle gear 630 and the rack gear 611 is excessively far from each other, the pinion 410 may not engage with the gear teeth 631 and 632 of the idle gear 630. Accordingly, the spaced distance L between the gear teeth 631 and 632 of the idle gear 630 and the rack gear 611 may be formed longer than the one pitch (1*P1 or 1*P2) and formed shorter than a distance between three gear teeth of the rack gear 611 (two pitch, 2*P1). That is, the pinion 410 may engage with the idle gear 630 at a moment when the rack gear 611 of the first rack member 610 passes over the pinion 410.

The idle gear 630 may be installed to be elastically moveable up and down. Thus, although the release rack gear assembly may no longer be moved rearward, the idle gear 630 may eliminate a rotation force of the pinion 410 by being elastically moved up and down even when the pinion 410 is rotated. That is, the pinion 410 idles and may not transmit power.

For the up and down movement of the idle gear 630, in the rack member 610, a first seating step 633 may be provided at an upper side of the idle gear 630, and an elastic member for up and down movement 634 may be provided between opposed surfaces on the first seating step 633 and the idle gear 630. This may be shown in FIG. 23.

The elastic member for up and down movement 634 may be positioned at a portion of an upper surface of the idle gear 630, the portion being the upper side between the two gear teeth 631 and 632 or the upper side of a rear side gear tooth 631. That is, the elastic member for up and down movement 634 pressurizes the portion so that it is possible that the idle gear 630 is prevented from being turned front to back when the pinion 410 is rotated.

The idle gear 630 may be installed to be elastically moveable back and forth. Thus, even when the idle gear 630 does not have the same pitch as the rack gear 611 of the first rack member 610, the pinion 410 may be engaged precisely with the idle gear and the damage caused when the gear teeth 631 and 632 of the idle gear 630 are forcibly engaged with the pinion 410 may be prevented.

For the back and forth movement of the idle gear 630, in the first rack member 610, a second seating step 635 is provided at a position blocking the front of the idle gear 630 and an elastic member for back and forth movement 636 is provided between opposed surfaces on the second seating step 635 and the idle gear 630.

The first rack member 610 may be further provided with a cover body 637 surrounding the exterior of the idle gear 630. That is, the cover body 637 may prevent that various foreign materials enters the idle gear 630, thereby preventing malfunction of the idle gear 630 due to the foreign materials.

The cover body 637 may prevent a problem in that the idle gear 630 is displaced to the side.

A supporting protrusion 638 may be provided at a side wall of the idle gear 630, the supporting protrusion 638 may be configured to support by passing through the cover body 637. This may be shown in FIG. 24.

Lower ends of the two gear teeth 631 and 632 constituting the idle gear 630 may be positioned lower than a lower end of the rack gear 611.

That is, since the idle gear 630 is installed to be elastically moveable up and down, the idle gear 630 is positioned lower than the rack gear 611 so that initial engagement between the idle gear 630 and the pinion 410 may be performed precisely and stably.

The confining protrusion part 650 may confine the second rack member 620.

The confining protrusion part 650 may be a single body in which an upper surface is closed and a lower surface is opened, and may be installed on a front upper surface (bottom surface in storage chamber) of the bottom 120 constituting the cabinet 100.

More particularly, the confining protrusion part 650 may be inserted in the protrusion passing hole 513 that is formed through the cover plate 510. When the cover plate 510 is not provided, the protrusion passing hole 513 is formed through the upper surface (bottom surface in storage chamber) of the bottom 120 of the cabinet 100 so that the confining protrusion part 650 is provided therein.

An inner width of the protrusion passing hole 513 may be larger than an outer width of the confining protrusion part 650, and a confining holder 654 may prevent outward exposure of a gap between the protrusion passing hole 513 and the confining protrusion part 650, the gap being generated by width difference between the protrusion passing hole 513 and the confining protrusion part 650. This may be shown in FIG. 26.

The confining holder 654 may be coupled to the upper surface (e.g., upper surface of bottom) of the cover plate 510. The confining holder 654 may be configured of a protrusion through hole 654*a* at the center thereof and a circumference portion, the protrusion through hole 654*a* may be provided so that the confining protrusion part 650 passes therethrough and the circumference portion of the confining holder 654 blocks the gap between the protrusion passing hole 513 and the confining protrusion part 650 and may be coupled to the cover plate 510.

A coupling end 656 may protrude outwards from a circumferential surface of the confining protrusion part 650, and a raising guide 654*b* is formed by protruding from a lower surface of the confining holder 654 to pass through the coupling end 656 from the top to the bottom. Coupling ends 656 are respectively formed by protruding from opposite sides of the confining protrusion part 650, and raising guides 654*b* are formed at opposite sides of the confining holder 654 to pass through the coupling ends 656, respectively.

The raising guide 654*b* may support up and down movement of the confining protrusion part 650.

The confining protrusion part 650 may be installed to be elastically moved up and down in the protrusion passing hole 513 by an elastic member 651.

That is, when pressure is applied to the confining protrusion part 650, the confining protrusion part 650 is moved downward into the protrusion passing hole 513, and when the confining protrusion part 650 is not under pressure, the confining protrusion part 650 is moved upward from the protrusion passing hole 513 so that a part thereof is exposed (protrude) to the inside of the lower storage chamber 3.

The elastic member 651 may be a coil spring, and a spring engagement protrusion 652 may protrude downward from the inside of the confining protrusion part 650. The elastic member 651 is configured such that an upper end thereof passes through a lower surface of the confining protrusion part 650 and then is engaged with the spring engagement protrusion 652 of the confining protrusion part 650.

The confining protrusion part 650 is in rear of the pinion 410, and is provided to be as close as possible to the pinion 410.

At a center portion of an upper surface of the confining protrusion part 650, a slope 653 is inclined upward such that the front is low and the rear is high. As the locking member 673 of the confining module 670 is moved backward along the slope 653, the confining protrusion part 650 is moved backward.

The confining module 670 may confine the second rack member 620 before the first rack member 610 is fully pushed out.

The confining module 670 may include the confining protrusion part 650, the stopper member 671, the holder 672, and the locking member 673.

The stopper member 671 may be installed in the motion groove 622 of the second rack member 620, and may function to restrict the rearward movement of the second rack member 620. A length (from the front to the rear) of the stopper member 671 may be shorter than a length (from the front to the rear) of the motion groove 622, so that the stopper member 671 is installed to be moveable in forward and rearward directions within the motion groove 622.

The stopper member 671 may include a confining hook 671*a* at a lower surface of a front end thereof, the confining hook 671*a* protruding downward. When the drawer 200 is closed to enter the preset distance, the confining hook 671*a* is hit at a front surface of the confining protrusion part 650 to prevent the stopper member 671 and the first rack member 610 from being moved backward.

A holder groove 671*b* may be provided on a front upper surface of the stopper member 671, and a locking member through hole 671*c* may be provided on a rear side portion of the stopper member 671.

The holder groove 671*b* may be gradually inclined downward such that the front is high and the rear is low. Therefore, when the holder 672 received inside the holder groove 671*b* is moved forward, the holder 672 may be easily separated from the holder groove 671*b*.

The holder 672 may restrict the forward and rearward movement of the stopper member 671.

A lower end of the holder 672 is received in the holder groove 671*b* of the stopper member 671, and an upper end of the holder 672 is installed to pass through a first through hole 622*a* of the second rack member. Thus, the first rack member 610 may be pushed out by the preset distance to lead the second rack member 620, the holder 672 moved forward with the second rack member 620 is separated from the holder groove 671*b* and is received in the first receiving groove 614*a* of the first rack cover 614.

The holder 672 may have inclined front upper and lower edges, and a front lower edge of the holder 672 may be inclined at the same slope as the holder groove 671*b*. Thus, the holder 672 may be easily separated from the holder groove 671*b*.

The holder 672 has a cut groove 672*a* that is cut in forward and rearward direction on an upper surface of the holder 672, and an insert protrusion 633 received in the cut groove 672*a* is provided on a lower surface of the first rack cover 614, the lower surface thereof facing the upper surface of the holder 672, the insert protrusion 633 is formed from a front end of the first rack cover 614 to the first receiving groove 614*a*. Due to a structure between the cut groove 672*a* and the insert protrusion 633, during movement of the first rack member 610, the holder 672 is prevented from being moved laterally so as to be precisely received in the first receiving groove 614*a*. The cut groove 672*a* and the insert protrusion 633 may be provided in plural.

The locking member 673 may prevent the forward movement of the second rack member 620 by being locked in a position of the rear of the confining protrusion part 650 until the first rack member 610 is pushed out by the preset distance.

The locking member 673 may move upward when the first rack member 610 and the first rack cover 614 are pushed out by the preset distance and may move with the second rack member 620 and the second rack cover 624. The locking member 673 is inserted in the second receiving groove 614*b* of the first rack cover 614 positioned above the locking member to be operated for releasing the engagement with the confining protrusion part 650.

An extending step 673*a* may be provided at an upper end of the locking member 673 in a shape of extending laterally, and a raising guide step 623 may be provided on opposite side portions of the second through hole 622*b* at a front upper surface of the second rack member 620. The raising guide step 623 may have a rounded shape (or inclined shape) so as to raise the extended step 673*a* when the first rack member 610 and the first rack cover 614 are pushed out by the preset distance and moved with the second rack member 620 and the second rack cover 624.

When the first rack member 610 and the first rack cover 614 are pushed out by the preset distance and moved with the second rack member 620 and the second rack cover 624, the raising guide step 623 provided on the second rack member 62 raises the extended step 673*a* of the locking member 673, thus the locking member 673 rises up to a height where the locking member 673 is not hit from the confining protrusion part 650.

The raising guide step 623 may be rounded or inclined upward such that the front is low and the rear is high. The raising guide step 623 may be gradually inclined upward such that the front (at the center of the opposite side portions of second through hole 622*b*) is low and the rear is high. That is, the raising guide step 623 may be provided so that the locking member 673 is not affected by the raising guide step 623 when it is positioned in the front of the second through hole 622*b*, and is gradually moved upward by affecting by the raising guide step 623 when the locking member 673 is moved to the rear of the second through hole 622*b* by the forward movement of the second rack member 620.

The extended step 673*a* of the locking member 673 is preferably rounded or inclined like the raising guide step 623.

A lower surface of the locking member 673 is inclined upward such that the front is low and the rear is high. A slope of the lower surface of the locking member 673 is the same as the slope 653 formed at the center of the upper surface of the confining protrusion part 650.

According to an embodiment of the present disclosure, operation of the refrigerator may be described with reference to FIGS. 27 to 34.

The drawer 200 is maintained in a closed state unless otherwise manipulated. This may be shown in FIGS. 27 and 28.

In the closed state, when a manipulation is performed to open the drawer 200 at the user's need, the driving motor 420 may operate while power is supplied to the driving part 400.

The manipulation for opening the drawer 200 may be a manipulation of a button 6 (touch or pressure type) or an operation control of a control program that senses proximity of the user.

When the driving motor 420 is operated by the manipulation, the two pinions 410 may simultaneously rotate, and thus the drawer 200 may open forward while the rack gears 611 and 621 (of the two rack gear assemblies 601 and 602) engaged with the pinions 410 are operated.

The first rack member 610 (or first rack) and the first rack cover 614 are preferentially pushed out while being operated simultaneously, and then the second rack member 620 (or second rack) and the second rack cover 624 are subsequently pushed out.

While the first rack member 610 and the first rack cover 614 are simultaneously operated and pushed out, the locking member 673 is maintained in a confined state to the confining protrusion part 650, so that the second rack member 620 (or second rack) and the second rack cover 624 are maintained in an initial position.

When the first rack member 610 and the first rack cover 614 are pushed out by the preset first distance and the linkage protrusion 681 comes into contact with the linkage step 682, the second rack member 620 and the second rack cover 624 move forward with the first rack member 610 from the contact point. This process may be shown in FIGS. 29 and 30.

However, the locking member 673 may be confined to the confining protrusion part 650, so the stopper member 671 through which the locking member 673 passes is maintained in place while the second rack member 620 moves forward. In the above process, the extended step 673*a* of the locking member 673 may gradually climb to the raising guide step 623 provided in the second rack member 620, and the locking member 673 is moved upward and is separated from the confining protrusion part 650. This process may be shown in FIGS. 31 and 32.

After that, the stopper member 671 may move forward with the second rack member 620 while contacting a rear surface in the motion groove 622 and passing the confining protrusion part 650.

While the second rack member 620 and the second rack cover 624 move following the first rack member 610 and the first rack cover 614, the rack gear 621 (of the second rack member 620) is engaged with the pinion 410 just before the rack gear 611 (of the first rack member 610) is separated from the pinion 410. As the rack gear 611 (of the first rack member 610) is separated from the pinion 410 by rotation of the pinion 410 and at the same time only the rack gear 621 (of the second rack member 620) is moved by being engaged with the pinion 410, and the drawer 200 may be further moved forward. This process may be shown in FIG. 33.

After movement of the second rack member 620 is finished, the storage bin 220 (of the drawer 200) is in a maximum opened state. When the maximum opened state of the storage bin 220 is checked (for example, the maximum opened state is sensed by open/close sensing part), the raising/lowering module 300 (or lift module) is operated to raise up the container 240 in the storage bin 220.

Accordingly, the user can take the container 240 out of the storage bin, take storage items out from the container 240, and/or put items into the container 240.

When closing operation of the drawer 200 is performed as the user completes use thereof, the driving motor 420 (constituting the driving part 400) may drive such that the pinion 410 is reversibly rotated, and thus the rack gear 621, engaged with the pinion 410, may operate such that the second rack member 620 is moved backward.

The first rack member 610 is moved rearward with the second rack member 620 by being moved in conjunction with the second rack member 620 by the linkage part 680.

After that, when a front end of the (second) rack gear 621 (of the second rack member 620) is positioned to be engaged with the pinion 410, a rear end of the (first) rack gear 611 of the first rack member 610 is also positioned to be engaged with the pinion 410. The (second) rack gear 621 of the second rack member 620 is then separated from the pinion 410, and only the first rack member 610 is moved rearward by the (first) rack gear 611 thereof.

When just before the second rack member 620 is fully moved rearward, the confining hook 671*a* of the stopper member 671 is blocked by the confining protrusion part 650, thereby no longer being moved rearward. Even though the stopper member 671 is hit, as the second rack member 620 is further moved by a moveable distance provided in the motion groove 622, the extended step 673*a* of the locking member 673 is separated from the locking member 673 so that the locking member 673 is moved downward.

After that, the second rack member 620 is also no longer moved backward by the stopper member 671, and the confining protrusion part 650 is positioned between the confining hook 671*a* of the stopper member 671 and the locking member 673 and confines the second rack member 620.

Accordingly, only the first rack member 610 is further moved rearward and returned to an initial position (position where storage bin is fully pushed in). When completion of the return movement is sensed, driving of the driving motor 420 is stopped and the closing movement of the drawer ends.

When opening and closing operation of the drawer 200 is performed, the drawer 200 may be closed obliquely such that opposite sides of the drawer are not in a horizontal state but rather one side is further forward than the other side.

That is, although a rack gear of any one rack gear assembly of the rack gear assemblies 601 and 602 is engaged with the pinion 410 one pitch later than a rack gear of the other rack gear assembly by user carelessness, when the two pinions 410 are rotated at the same time by operation of the driving motor 420, the drawer 200 is inserted into the lower storage chamber 3 with oblique opposite sides.

In this process, when any one side (for example, a side where open/close sensing part is provided) of the drawer 200 is closed before the other side of the drawer, the open/close sensing part 514 may sense the closing and then additional operation of the driving motor 420 may be controlled.

That is, the driving motor 420 may be controlled to be further operate by the predetermined time or the predetermined number of rotations from when the closing of the drawer 200 is sensed. Therefore, the release rack gear assembly, which relatively less closed among the rack gear assemblies 601 and 602 that are engaged with the pinion 410, may be engaged with the pinion 410 to the portion where the idle gear 630 is provided.

The idle gear 630 may be provided with a pulling force by the pinion 410 by the spaced distance (higher than one pitch and less than two pitch) from the rack gear 611, whereby the release rack gear assembly 602 may easily move.

The engagement between the pinion 410 and the idle gear 630 may be performed stably and precisely by the elastic member 634 and 636.

On the other hand, when the other side (for example, the side opposite to a side where the open/close sensing part is provided) of the drawer 200 is closed before the one side of the drawer 200, the two pinions 410 may continuously rotate until the open/close sensing part 514 senses the closing of any one side of the drawer 200.

Since the idle gear 630 provided in the release rack gear assembly that is closed before the other rack gear assembly is engaged with the pinion 410, and the idle gear 630 receives a horizontal movement force by the rotational force of the pinion 410 and the idle gear performs additional rearward movement of the release rack gear assembly.

Since the drawer 200 has the packing member on the contact surface between the front panel 210 and the cabinet 100, a side of the drawer 200 where the release rack gear assembly is provided may be further moved rearward by a compressive force of the packing member.

However, when the drawer 200 is moved until the packing member is in a maximum compressed state, the idle gear 630 engaged with the pinion 410 is moved upward (referring to FIG. 34) and temporarily released from engagement with the pinion 410, whereby the pinion 410 idles.

The other pinion 410 may continuously move the general rack gear assembly rearward while being engaged with the rack gear 611 of the general rack gear assembly, so that the side, which corresponds to the other pinion, of the drawer is closed later.

When the closing of the drawer is sensed, the driving motor 420 is controlled from this time to perform the additional operation by the predetermined time or the predetermined number of rotations and then the operation is deactivated.

Accordingly, even when any one side of the drawer 200 is closed before the other side of the drawer, the opposite sides of the drawer 200 may be fully closed by the additional operation of the driving motor 420 and providing the idle gear 630.

The refrigerator of example embodiments is not limited to the structure of the embodiments described above.

That is, the rack gear assemblies 601 and 602 may be provided only with the first rack member 610 (or first rack). In this example, the idle gear 630 may be installed in front of the (first) rack gear 611 (of the first rack member 610), and an installation structure thereof may also be provided to be capable of back and forth elastic movement and up and down elastic movement same as the above-described embodiment.

The rack gear assemblies 601 and 602 may also be formed by including at least three rack members. In this example, the idle gear 630 is provided in front of the (first) rack gear 611 of a rack member that is positioned at the front of the rack members based on the movement direction of the drawer 200, and an installation thereof may be provided to be capable of back and forth elastic movement and up and down elastic movement same as the above-described embodiment.

The idle gear 630 constituting the refrigerator of the present disclosure may be embodied in various shapes.

As described above, the refrigerator of the present disclosure is provided with the rack gear assembly 601 that includes the idle gear 630. The idle gear 630 may idle the pinion 410 by being engaged with the gear teeth of the pinion 410, so that the drawer 200 can be fully closed even when the opposite sides of the drawer 200 are not moved parallel.

In the refrigerator of the present disclosure, the driving motor 420 (of the driving part 400) is configured to perform additional operation from when the closing of the drawer 200 is sensed and then to deactivate the operation, so that the drawer 200 can be fully closed even when the opposite sides of the drawer 200 are not moved parallel.

In the refrigerator of the present disclosure, the open/close sensing part 514 is provided at the opposed surfaces on the drawer 200 and the cabinet 100 to sense opening and closing of the drawer 200, so that operational control of the driving motor 420 can be performed precisely.

In the refrigerator of the present disclosure, the open/close sensing part 514 is provided with the sensor 514*a* and the sensing member 514*b*, and the sensor 514*a* and the sensing member 514*b* are respectively provided at the opposed portions between the storage chamber 3 and the drawer 200, so that opening and closing of the drawer 200 can be sensed accurately.

In the refrigerator of the present disclosure, the sensor 514*a* is provided at the bottom in the storage chamber 3 and the sensing member 514*b* is provided at the lower surface of the storage bin 220 (constituting the drawer 200), so that installation and maintenance thereof can be performed easily.

In the refrigerator of the present disclosure, the sensor 514*a* is the hall sensor and the sensing member 514*b* is the magnet, so that the user can accurately recognize opening and closing of the drawer 200.

In the refrigerator of the present disclosure, the (first) rack gear 611 is operated to be further moveable by at least one pitch from when closing of the drawer 200 is sensed, the drawer 200 can be closed accurately.

In the refrigerator of the present disclosure, the pinion 410 is provided to be rotated only two rotations or less from when closing of the drawer 200 is sensed, so that damage to the pinion 410 or the rack gear 611 can be prevented (or reduced).

In the refrigerator of the present disclosure, the idle gear 630 is provided at at least one of the rack gear assemblies 601 and 602, so that damage to the (first) rack gear 611 and the pinion 410 can be prevented (or minimized) even when the one side of the drawer 200 (where the rack gear assembly with the idle gear is provided) is closed before the other side of the drawer 200.

In the refrigerator of the present disclosure, the idle gear 630 is provided in front of the (first) rack gear 611 of the first rack member 610, so that the idle gear 630 can engage with the pinion 410 only when the drawer 200 is closed.

In the refrigerator of the present disclosure, the idle gear 630 is provided with at least one gear tooth, so that the idle gear 630 can engage with the pinion 410.

In the refrigerator of the present disclosure, the idle gear 630 is provided with two gear teeth 631 and 632 and is formed to have the same pitch as the rack gear 611, so that the idle gear 630 can be precisely engaged with the pinion 410.

In the refrigerator of the present disclosure, the distance L between the idle gear 630 and the rack gear 611 is formed longer (or greater) than the pitch P1 of the rack gear 611, so that the idle gear 630 can be provided with the pulling force by the pinion 410 for easily forced movement.

In the refrigerator of the present disclosure, the distance L between the idle gear 630 and the rack gear 611 is formed shorter than the distance between three rack teeth of the rack gear 611, so that engagement between the idle gear 630 and the pinion 410 can be precisely performed.

In the refrigerator of the present disclosure, lower ends of the two gear teeth 631 and 632 (included in the idle gear 630) is positioned lower than a lower end of the rack gear 611, so that engagement between the idle gear 630 and the pinion 410 can be precisely performed.

In the refrigerator of the present disclosure, the idle gear 630 is elastically moveable up and down, so that the idle gear 630 can be released from engagement with the pinion 410 when the drawer 200 is closed and the opposite sides of the drawer 200 can be fully closed.

In the refrigerator of the present disclosure, the idle gear 630 is elastically moveable back and forth, so that the idle gear 630 can be stably engaged with the pinion 410 and may be provided efficiently with the pulling force by the pinion 410.

In the refrigerator of the present disclosure, the idle gear 630 is elastically moveable up and down by the elastic member for up and down movement 634, so that the idle gear 630 can be engaged with the pinion 410 or be released from the engagement with the pinion easily.

In the refrigerator of the present disclosure, the elastic member for up and down movement 634 is positioned at the portion of the upper surface of the idle gear 630, the portion being the upper side between the two gear teeth 631 and 632 or the upper side of the gear tooth relatively close to the rack gear 611, so that malfunction such as overturning of the idle gear 630 may be prevented.

In the refrigerator of the present disclosure, the idle gear 630 is elastically moveable back and forth by the elastic member for back and forth movement 636, so that back and forth movement of the idle gear 630 may be performed.

In the refrigerator of the present disclosure, the first rack member 610 is further provided with the cover body 637 for surrounding the exterior of the idle gear 630, so that malfunction due to damage to the idle gear or entering of foreign material may be prevented.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such that drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

at least first and second pinions positioned at a lower surface of the storage chamber;

a driving motor to supply a driving force for rotation of the first and second pinions; and at least two rack gear assemblies positioned at a lower surface of the storage bin, and to operate based on rotations of the first and second pinions so that the drawer moves between the first position and the second position, wherein the first rack gear assembly includes:

a first rack having a first rack gear to engage with gear teeth of the first pinion; and an idle gear provided at the first rack to engage with the gear teeth of the first pinion, and the idle gear to allow the first pinion to idle, wherein lower ends of teeth of the idle gear are lower than a lower end of gear teeth of the first rack gear.

2. The refrigerator of claim 1, wherein a sensing device is provided at the drawer and the cabinet, and when the sensing device senses closing of the drawer, the driving motor is to provide a driving force for providing a driving operation by a predetermined time or a predetermined number of rotations from when the closing of the drawer is sensed, and then the driving motor is to deactivate the driving operation.

3. The refrigerator of claim 2, wherein the sensing device comprises:

a sensor provided at the storage chamber; and a sensing member to be sensed by the sensor.

4. The refrigerator of claim 3, wherein the sensor is provided at a bottom in the storage chamber, and the sensing member is provided at a lower surface of the storage bin.

5. The refrigerator of claim 3, wherein the sensor is a hall sensor, and the sensing member is a magnet.

6. The refrigerator of claim 2, wherein the driving motor is configured to provide the driving force for performing the driving operation from when the closing of the drawer is sensed by the sensing device, and then the driving motor is to deactivate the driving operation, wherein the driving operation is to be performed for an amount of time or a number of rotations in which the first rack gear is further moved by at least one pitch of gear teeth of the first rack gear.

7. The refrigerator of claim 6, wherein the driving motor is configured to provide the driving force for performing the driving operation from when the closing of the drawer is sensed by the sensing device, and then the driving motor is to deactivate the driving operation, wherein the driving operation is to be performed so that the first pinion is further rotated by two rotations or less.

8. The refrigerator of claim 1, wherein the idle gear is provided at the first rack of the first rack gear assembly.

9. The refrigerator of claim 8, wherein the idle gear is positioned in front of the first rack gear provided at the first rack of the first rack gear assembly.

10. The refrigerator of claim 9, wherein the idle gear includes one gear tooth to engage with the gear teeth of the first pinion.

11. The refrigerator of claim 10, wherein the idle gear includes two gear teeth, and a pitch of the two gear teeth of the idle gear is same as a pitch of two of the gear teeth of the first rack gear.

12. The refrigerator of claim 11, wherein the idle gear is to elastically move up such that the idle gear is released from engagement with the first pinion, and the idle gear to elastically move down such that the idle gear is engaged with the first pinion.

13. The refrigerator of claim 12, wherein the idle gear is to elastically move back and forth for engagement and release with the first pinion.

14. The refrigerator of claim 13, wherein the first rack includes a first seating step provided at an upper side of the idle gear, and a first elastic member for up and down movement is provided between the first seating step and the idle gear.

15. The refrigerator of claim 14, wherein the first elastic member for up and down movement is positioned at a portion of an upper surface of the idle gear, the portion being positioned in the upper side of the idle gear between the two gear teeth of the idle gear.

16. The refrigerator of claim 14, wherein the first rack includes a second seating step provided in front of the idle gear, and a second elastic member for back and forth movement is provided between the second seating step and the idle gear.

17. The refrigerator of claim 8, wherein the first rack includes a cover body to cover an exterior of the idle gear.

* * * * *